United States Patent [19]

Nitschke

[11] 4,134,284

[45] Jan. 16, 1979

[54] METHOD AND APPARATUS FOR THE MANUFACTURE OF HOLLOW BODIES

[76] Inventor: Achim Nitschke, Georg-Wilhelm-Strasse 34, Hamburg 93, Germany, D-2102

[21] Appl. No.: 802,306

[22] Filed: Jun. 1, 1977

[51] Int. Cl.[2] ..... B21D 22/14

[52] U.S. Cl. ..... 72/84; 72/87; 72/106; 72/107; 72/110; 113/120 H

[58] Field of Search ..... 113/120 H, 1 G; 72/86, 72/87, 110, 67, 68, 105, 106, 107, 84, 284, 262; 425/366

[56] References Cited

U.S. PATENT DOCUMENTS

| | | | |
|---|---|---|---|
| 2,964,089 | 12/1960 | Kunz | 72/106 |
| 3,572,075 | 3/1971 | Sporck | 72/86 |
| 3,656,332 | 4/1972 | Marcovitch | 72/107 |

*Primary Examiner*—Lowell A. Larson
*Attorney, Agent, or Firm*—Toren, McGeady and Stanger

[57] ABSTRACT

Hollow bodies are produced from deformable plane or conically shaped blanks by rotating the blanks about an axis extending at least approximately through the cross-sectional center of gravity of the hollow body to be formed and simultaneously forming undulations in the blank. The undular shaping involves continuous formation of a propagating wave having a directional component extending in a circumferential direction, with the wave being transposed by repeated undular shaping in a direction generally radially of the body to be formed. The waves are transposed exclusively parallel to the original plane of the blank and in a single directional sense toward the hollow body to be formed. In the formation process, the material is worked out of its original plane in a deflection zone annularly surrounding the cross-sectional center of gravity of the hollow body in the formation of the hollow body wall. The forming process may be performed by apparatus which includes a rotatable roll with undularly extending generatrices.

70 Claims, 29 Drawing Figures

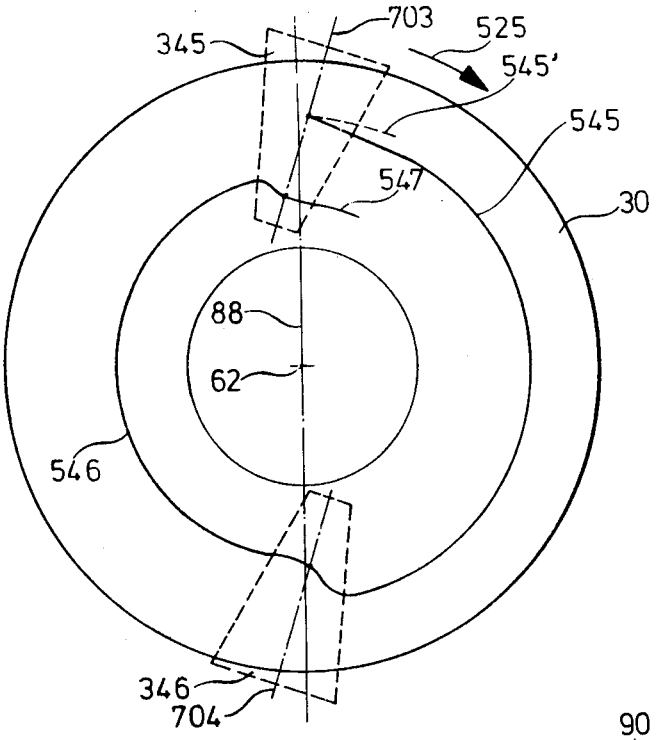
FIG. 16
FIG. 13
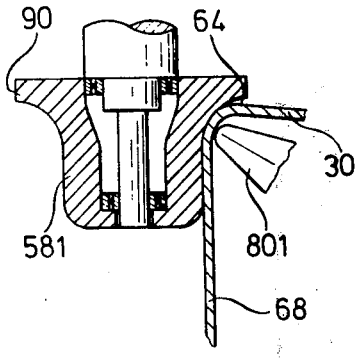
FIG. 17
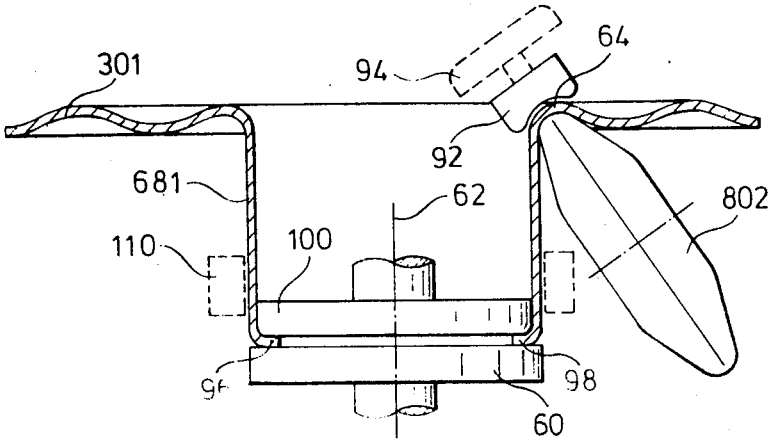

METHOD AND APPARATUS FOR THE MANUFACTURE OF HOLLOW BODIES

BACKGROUND OF THE INVENTION

The invention relates to a process for producing a hollow body from a plane or conical material plate consisting of a formable material, in particular, metal. Further the invention relates to an apparatus for the practice of such a process.

A known process of metal spinning of this type is described for example in the book by W. Sellin: "Metalldrucken", 1955, pages 4 to 12. In it, a blank which is at first shaped as a plane metal disk can be clamped at its center for example between an outer chuck and a contact plate and be driven in rotation together therewith. With repeated pivotal movements of a spinning or "pushing" tool the blank is applied against the chuck step by step until the desired final form is obtained. As the spinning tool is being guided by hand or by a programmed control, a number of successive small and large pivotal movements are executed by this tool alternately toward and away from the clamped center, the pivotal movements preferably intersecting. Therefore, the waves formed in the blank by the spinning tool are shifted parallel to the respective plane of the blank, but with a directional component increasingly perpendicular to the original plane of the blank, in alternating directions toward and away from the clamped center. With some skill the spinner can thus achieve a uniform wall thickness of the formed hollow body. Yet in practice it is difficult to avoid subjecting the material of the blank to high tensile stresses in some areas. For this reason, with automatic execution of the process on program-controlled machines, only small degrees of deformation can be obtained.

The present invention is directed toward the task of providing a process for producing a hollow body wherein the occurrence of tensile stresses in the material during the fabrication thereof is, to a very large extent, avoided.

It is an object of the invention thus to provide a process for producing hollow bodies which can be carried out with greater ease and with more reproducible results than with previous processes, wherein high degrees of deformation can be attained, and which permits production of hollow bodies of any desired forms. Hollow bodies which may be produced according to the invention include bodies having different cross-sections taken lengthwise of the direction of the hollow body. Thus, the problem sought to be overcome by the invention to avoid tensile stresses occurring in the material with known processes and to cause the material to flow by exerting thereon exclusively, or at least predominantly, compressive forces may be achieved.

SUMMARY OF THE INVENTION

The problem is solved essentially in that waves formed in a material plate are shifted exclusively parallel to the original plane of the material plate and in a single direction toward the hollow body to be formed, and that in the formation of the hollow body wall the material is brought out of the original plane of the material plate in a deflection zone spaced from and annularly surrounding the cross-sectional center of gravity of the hollow body to be formed.

In the process according to the invention, the shifting of the material of the blank along the original plane of the blank occurs always toward the deflection zone. This material transport results through the physical transposition of waves formed in the blank. However, the original shape of the blank is preserved and only its radial dimensions are reduced more and more toward the deflection zone. Due to the transposition of the waves, the material of the blank is subjected exclusively or at least by far predominantly to compressive stresses, whereby the occurrence of harmful tensile stresses is avoided. Due to the compressive forces exerted on the material, it also flows through the deflection zone and can be discharged therefrom, this discharging being in principle possible also without producing tensile stress. Thus, relatively high degrees of deformation of the hollow body in comparison to the blank can be attained.

With respect to achievement of flowing the material exclusively toward and through the deflection zone, the process of the invention can be compared with a codirectional flow process, where a thick blank is placed in a dished tool having a central die or "nozzle" and is pressed through the die by means of a ram under high pressure. However, in such a process very high internal tensile stresses occur in the material, since the surfaces thereof lying at the tool and in the depression are retained by friction while internal material layers of the blank flow. The codirectional flow process therefore requires strong, precision-machined tools, which are subject to high wear, and it is suitable only for materials having a ductility of more than 30%. Also, expensive further machining of the hollow body to be obtained is necessary.

The process of the invention may also be comparable, with respect to the flow direction of the material, with a deep drawing process, the blank being placed on a drawing die, applied by means of a hold-down plate, and drawn into the opening of the drawing die by means of a ram. Here, however, the material is subjected to very high stress particularly in the deflection zone at the drawing die because of the occurring intense form variation and, after passing through the drawing die, because of the tensile forces acting thereupon. Therefore, the attainable deformation is limited.

An apparatus for the practice of the process according to the invention takes its departure from a known design with a rotating roll with wavy generatrices and includes a rotating abutment opposite the roll at a nip.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawngs:

FIGS. 12 and 13 are schematic plan views showing modified versions of the apparatus to FIGS. 9 to 11;

FIG. 16 is a side view of a portion of the apparatus according to FIG. 15;

FIG. 17 is a sectional view depicting a possible modification of the apparatus according to FIGS. 9 to 15;

DETAILED DESCRIPTION OF THE PREFERRED EMBODIMENTS

Figure 1:
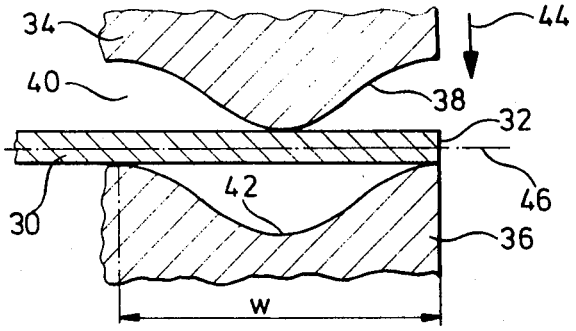
FIGS. 1 to 8 are views showing first process steps in the shaping of a metal plate.

Referring to the drawings wherein like parts are referred to with identical reference characters and wherein similar parts are referred to with reference characters having their first two digits identical, FIG. 1 shows in transverse section a material plate 30, which extends leftwardly from an outer edge 32 shown at the right of FIG. 1, and normal to the drawing plane. Above the material plate 30 is a machining tool 34, with an opposed counter-tool 36 being located on the underside of plate 30.

The tool 34 has an obtusely arched working face 38, which in the embodiment shown is of a sinusoidal configuration, and the tool 36 has a working face 42 designed to cooperate with the face 38 at a nip 40.

Figure 2:
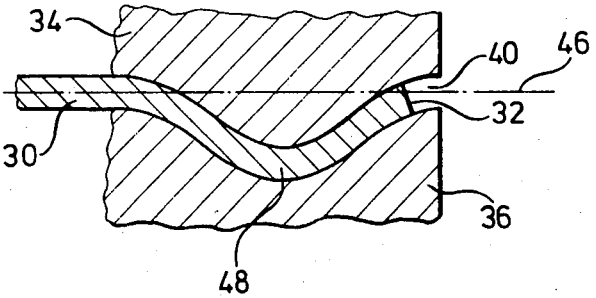

By pressing of the working face 38 of tool 34 downwardly in the direction of arrow 44, the plate 30 is, as is shown in FIG. 2, undularly deformed between the working faces 38 and 42 in such a way that there is formed in plate 30 a wave loop 48 arched downwardly relative to the original plate center line 46 indicated in broken lines in FIGS. 1 and 2. If the working faces 38, 42 have, as in the embodiment shown, a form such that, after the lowering of the tools 34, the nip 40 has a uniform width corresponding to the original thickness of plate 30, taken in a plane containing the axis of rotation of the plate 30 and measured normal to the respective position of the deformed plate 30, material of the plate 30 will, during the undular deformation, be drawn into the machining point. Since the inner side of the plate 30, the left side as seen in FIGS. 1 and 2, cannot yield or migrate outwardly, whereas edge 32 is free to migrate into the machining point, edge 32 is drawn into the nip 40. If, in view of the location of the axis of rotation, the width of the wave-shaped working face 38, measured in the plane of the drawing, is considered the radial wave width or wave length w (FIG. 1), then the inward displacement of edge 32 corresponds to the difference of the developed length of nip 40, with the tool 34 lowered according to FIG. 2, minus the radial wave length w.

Figure 3:
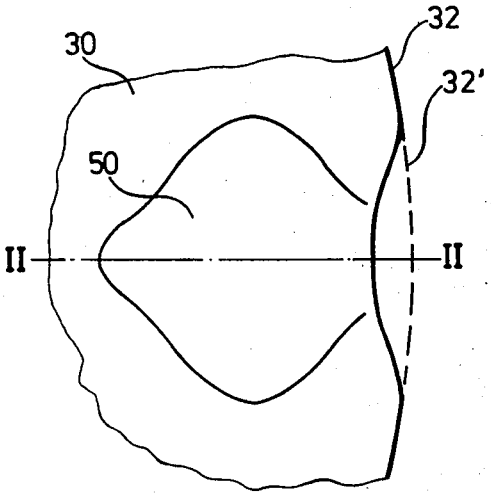

FIG. 3 is a top view showing plate 30 after the working face 38 has been pressed inwardly as shown in FIGS. 1,2. A dash-dot line II—II, extending radially with respect to the axis of rotation, of plate 30, indicates the location of nip 40 shown in FIG. 2. It can be seen that plate 30 has a deepened impression 50, which when seen in sectional view taken along the line II—II forms a downwardly directed wave trough or loop 48 shown in FIG. 2. Furthermore, it will be seen that the edge 32 is drawn inwardly relative to its original course 32' indicated in broken lines.

Figure 4:
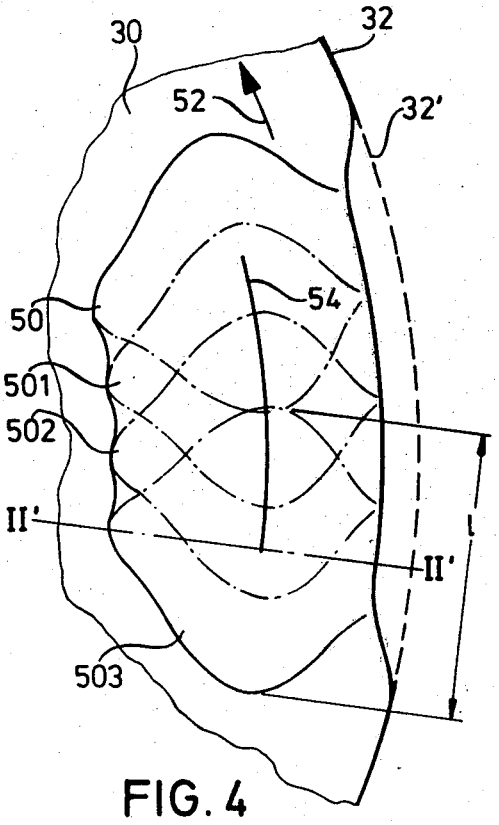

After the start of the undular shaping operation at a machining point, as explained with reference to FIGS. 1 to 3, plate 30 and the machining point are mutually rotated about the axis of rotation lying in the direction of line II—II at the left in FIG. 3, and with that the undular shaping is continued. This is indicated in FIG. 4. Although it is possible also to let the machining point revolve about the axis of rotation with the plate 30 held fixed, it is assumed in FIG. 4 that the machining point is held fixed and plate 30 is rotated. The position of nip 40, always the same with respect to angular position and radial position relative to the axis of rotation (FIGS. 1,2), is indicated in dash-dot line II'—II', while the direction of rotation of plate 30 is shown by an arrow 52. Further it is assumed that, with the counter tool 36 stationary (FIGS. 1,2), the machining tool 34 is moved up and down in rapid succession between the positions shown in FIGS. 1 and 2. This results in a succession of mutually overlapping, deepened impressions 50, 501, 502, 503, etc., which form a propagating wave 53 extending in the circumferential direction of the plate 30. For the wave 54 to have an approximately uniform shape in the circumferential direction, there should be chosen as a succession period in the pressing in of successive depressions, for example 502,503, a fraction of the quotient of the length 1 of a single depression, e.g. 503, measured in the circumferential direction and the circumferential relative velocity between plate 30 and the machining point.

When for example plate 30 is held and driven at its center, this axial support together with the mass inertia and form stiffness of plate 30 may suffice, and thereby the propagating wave 54 can be formed by continuous repeated pressing-in or hammering with a single tool 34, without requiring the presence of the contour tool 36 shown in FIGS. 1 and 2.

Alternatively to the described manner of producing the wave 54, the wave can be pressed in continuously by a roll rotating about its roll axis, as will be described hereinafter. In that case it is necessary to provide a counter tool, which may expediently be another roll, since plate 30 could otherwise be displaced relative to the original plate center line, as in known metal spinning.

Figure 5:
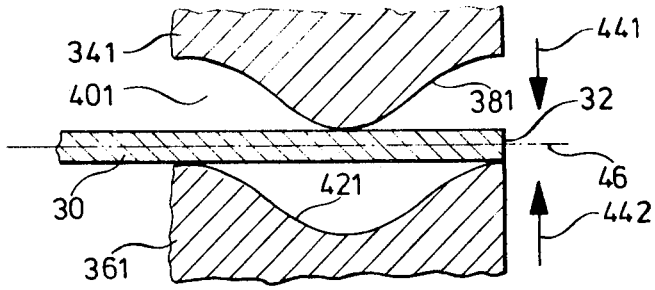
Figure 6:
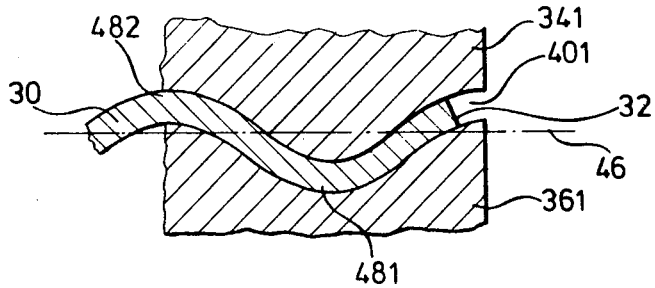

FIGS. 5 and 6 show, in a representation comparable with FIGS. 1 and 2, the beginning and continuation of the formation of a propagating wave. Again the material plate 30 is undularly deformed between an upper tool 341 with working face 381 and a lower tool 361 with working face 421. At variance with FIGS. 1 and 2, however, not only is the upper tool 341 pressed downwardly into plate 30 in the direction of arrow 441, but at the same time the lower tool 361 is pushed in the opposite direction, upwardly in the direction of arrow 442, through a displacement path equal to the displacement path of tool 341. Thus, at the same circumferential point of plate 30, alternating wave loops 481,482 are formed simultaneously in a radial direction, directed out of the original plate center line 46 to both sides and extending at least approximately in a sinusoidal form. The advantage of this is that, at equal heights of the wave loops 481,482 compared with FIG. 2, there is achieved a stronger curvature of plate 30 compared with the original plate center line 46 and hence a stronger drawing in of its edge 32.

Moreover, this mode of deformation is most favorable when the tools extend along plate 30 farther to the left then the position shown and enclose between them a nip 401 with several wave loops or wave loops and wave troughs (wave amplitudes), as will be more fully described hereinafter.

The wave 54 formed as previously described and extending in a circumferential direction (FIG. 4) is shifted radially inwardly. This procedure may be accomplished in a manner shown in FIG. 7. The tools 341,361 are shifted in a radial direction indicated by arrow 56. After each revolution, plate 30 thus encounters a nip 401 displaced radially relative to the original radial position (FIGS. 5,6) and it must adapt itself thereto. Thereby,wave 54 (FIG. 4) is displaced step by step at the machining point, and as a whole in the course of a renewed revolution of plate 30. The displacing of the tools 341,361 can be performed continuously and may be already begun at the start of the undular shaping near the edge 32. In this case, the formed propagating wave 54 will have a course unlike the course depicted in FIG. 4, and will include an additional radial component, so that the wave extends spirally. Instead of a physical radial displacement of the tools 341,361 themselves, a radial displacement of the working faces 381,421 can be effected by arranging the faces to extend helically on tools 341, 361 which may be formed as rolls and which may be rotated, in a manner to be more fully described hereinafter.

Figure 7:
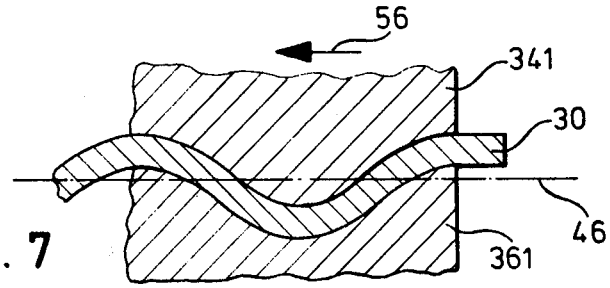
Figure 8:
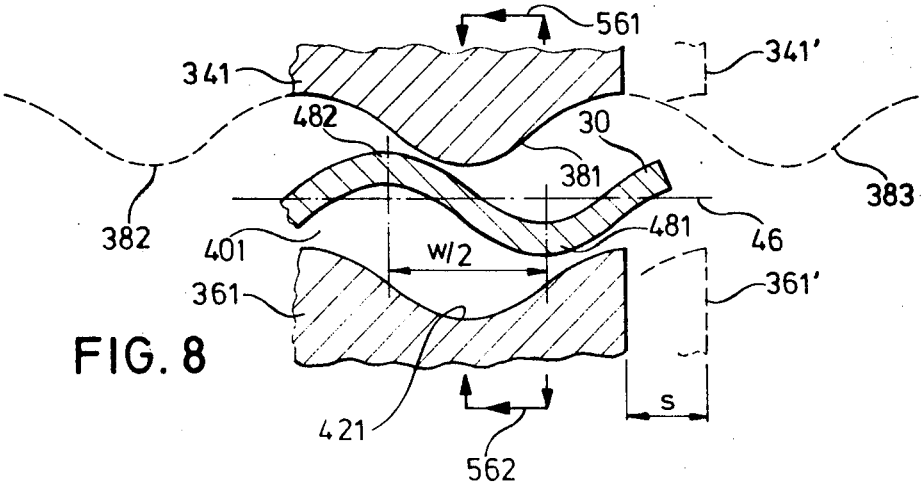

FIG. 8 illustrates a different manner for carrying out the transposition of the wave in the circumferential direction as compared with the approach depicted in FIG. 7. Here, the tools 341,361 are lifted off plate 30 as indicated by the succession of arrows 561,562 and are shifted radially inwardly and again pressed against plate 30. The tools 341,361 are shown in FIG. 8 just before the renewed pressing operation takes place whereby the previously formed wave is transposed radially. If the tools 341,361 are shifted through a distance s relative to their previously occupied radial positons 341',361' indicated in broken lines, the transposing of the wave likewise occurs through this distance s.

Referring now to the mode of production of the propagating wave according to FIGS. 5 and 6 and its displacement according to FIGS. 7 or 8, if the interval of successive passes of plate 30 in the radial direction through the original plate center line 46 is taken as one half of the wavelength w (w/2), then as can be seen from FIG. 8 the transposition of the previously formed wave will no longer occur when $a = w/2$. Then, in fact, in FIG. 8, as the tolls 341,361 are applied, the previously formed, upwardly directed wave loop 482 would simply be transformed into a downwardly directed loop, while a previously formed wave loop would be transformed into an upwardly directed loop, without any physical transposition of the wave taking place. It is important, therefore, that the transposition of a wave in the radial direction occurs by less than one half the wave length W measured in this direction. In a case where the tools 341,361 extend farther to the left than what has been shown, if they comprise several wave loops and wave troughs as working faces 381,421 and thereby form a multiply undulated nip 401, the additional transposition of the tools 341,361 is possible, apart from the equal transposition of the tools 341,361, due to the fact that for that purpose other machining points of the same tool 341,361 are brought into engagement with the same wave. For example, if to the left of the working face 381 there likewise exists a downwardly directed working face 382 of tool 341, indicated in broken lines, it could be displaced to the right by a distance w (1 - epsilon) from its previously occupied position 341' required by the given position of tool 341 indicated in broken lines, in order then, together with a corresponding concave working face of tool 361, to transpose the wave. This requires the condition $0 < \text{epsilon} < 0.5$.

Just as tool 341 can extend farther to the left, it can also, additionally or instead, be extended radially to the right in FIG. 8 and comprise as the next downwardly directed concave working face the working face 383 indicated in broken lines. It, too, can serve to transpose the wave previously formed according to FIG. 6 if for this purpose it is moved a distance w (1 + epsilon) with $0 < \text{epsilon} < 0.5$ radially inward, i.e. to the left in FIG. 8. With a plurality of existing concave working faces of tool 341, the latter can therefore be selectively moved a distance w (m - epsilon) radially outward and to the right in FIG. 8, or by a distance w (m + 1 = epsilon) radially inward and to the left in FIG. 8, m being a positive integer ($m = 1, 2, 3...$). The same reasoning applies to the tool 361, the displacement of which can occur, if desired, independently of that of the upper tool 341 and even in the opposite direction, as long as it is still possible thereby to bring into engagement with the previously formed wave a pair of mutually opposing working faces which transpose the wave.

The foregoing considerations whereby the desired radial transposition of a wave can be effected by corresponding displacement of the tools may be validly applied for a similar wave but with a new pair of machining tools. The same considerations will apply whether there is a relative rotation between machining point and the plate 30, or respectively, with a pair of stationary machining tools with respect to the angular position and with rotation of plate 30. The conclusions deriving from these considerations indicate that by radial inward and outward displacement of the same tool provided with at least two radially spaced working faces, the possibly of the counter tool, a repeated radial transposition of the wave in the desired direction can take place. These conditions are applicable, however, when the transposing of the same wave occurs at machining points lying one behind the other at angular distances and radially offset relative to each other. The advantage of this is that the tools provided at the individual machining points need not be physically adjusted or displaced in the radial direction. Furthermore, the conditions apply also when, as already described with reference to FIG. 7, the tools 341,361 are shifted radially in a continuous manner. Here too, care must be taken that an upwardly directed wave loop returning to the tool pair 341,361 after a complete revolution of plate 30 is transformed into a wave loop or wave trough of exactly opposite direction.

The plate 30 is drawn in radially close to its edges not only upon undular deformation as is illustrated in FIGS.

2 to 4 and 6, but also during the subsequent shifting of the formed wave. The material of the plate lying upstream, i.e. to the right of the machining point in FIGS. 7 or 8, can, upon the occurrence of undular deformation, flow toward the machining point more easily than the material lying downstream of the direction of flow. For this reason the material of plate 30 is caused in the practice of the process to flow radially inward more than was to be expected on the basis of those considerations which referring to FIGS. 1 to 6 dealt with the drawing in of edge 32 of plate 30. Also this factual situation means that the propagating wave, first formed and then displaced radially, need not start close to the edge 32 of plate 30 or extend to it. Surprisingly, the material of plate 30 is caused to flow radially inwardly also when waves are formed in an annular zone of plate 30 and are shifted radially inwardly, and when at first a further annular zone of plate 30 outside the first annular zone and having approximately the same radial width remains undeformed.

As is evident for example with reference to FIGS. 5 and 6, during the first forming of the propagating wave 54 (FIG. 4) the material of plate 30 is pushed out of the plate plane defined by the original plate center line 46, the material grain or "fiber" being subjected, as the two tools 341,361 approach each other, at first to compressive forces on the concave side of the formed wave loop 441 (FIG. 6) with the material grain lying on the convex side at least in radial direction being subjected to a tensile force. If substantially higher wave loops 481,482 are formed as compared with the representation in FIG. 6, then a tensile force would occur for example at the wave loop 481 also on the concave side thereof. It has been found that such a strong deformation of plate 30 is less favorable in view of the material stresses then occurring. It is sufficient if upon the first forming of the propagating wave the material plate 30 is defomed at the wave loops, e.g. 481, to such an extent that thereafter the material grain lying on the concave side, which is the upper in FIG. 6, is tension free at least in the radial direction. In this connection, it is intended that tensile and compressive stresses cancel each other.

Once the propagating wave is formed and is being transposed radially, additional forces, namely exclusively compressive forces, will occur with this transposition for example according to FIG. 7 or according to FIG. 8. It is evident, for example upon observation of FIG. 8, that as the two machining tools 341,361 approach the original plate center line 46, the two wave loops 481,482 are pushed from right to left, whereby transportation of the wave is brought about. By the exerted compressive forces, those material tensions which had occurred during the first formation of the wave on the convex side thereof can be compensated partly or wholly in such a way that throughout the material exclusively compressive forces prevail in the swelling pressure zone. Expediently the heights of the wave loops and wave troughs, i.e. of the machining faces 381,421 of the tools 341,361, are selected so that upon transposition of the wave the material plate 30 is deformed at the same loops 481,482 etc. to such an extent that thereafter the material grain lying on the convex side is at least approximately tension-free after possible elastic contraction. Owing to this, apart from slight tensile stresses elastically absorbed by the material, only compressive stresses prevail, whereby the flowing of the material is forcibly brought about.

Figure 9:
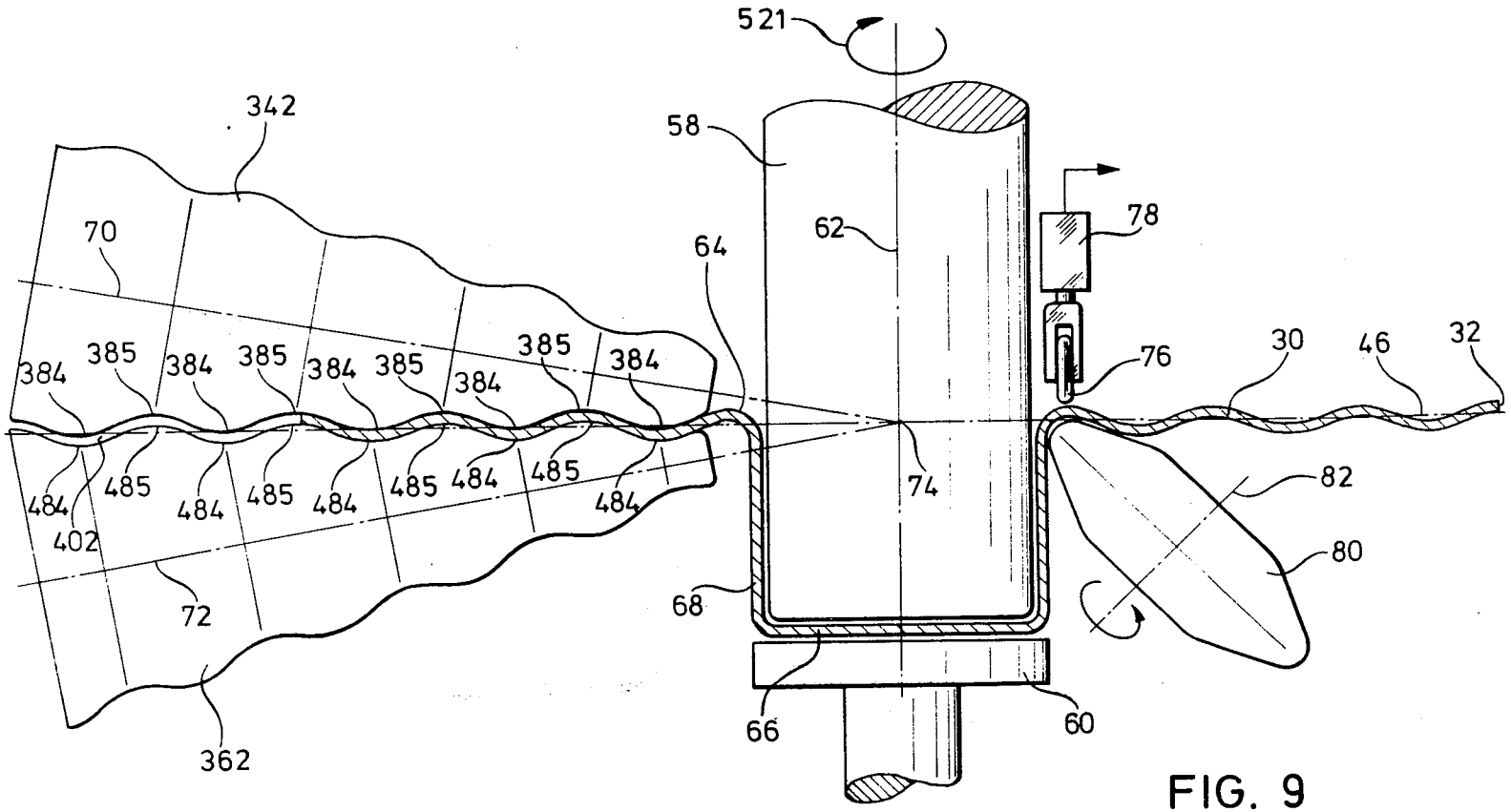
FIG. 9 is a sectional view showing apparatus for producing cylindrical hollow bodies.

FIG. 9 shows an apparatus for producing a cup type hollow body from what at first is a planar material plate or disk 30 with a circular outer edge 32. Disk 30 is held at its center between the flat end face of a cylindrical mandrel 58 and the opposite flat end face of a circular contact plate 30. Mandrel 58 and contact plate 60 extend coaxially with an axis of rotation 62 about which they revolve together with disk 30. The axis of rotation 62 extends perpendicularly to the plane defined by the original planar disposition of plate 30 represented by the center line 46.

At first the material of the disk is caused to flow radially inwardly along the original plate surface in the direction toward the hollow body to be formed, for which a pair of rolls 342,362 are used in a manner to be described in greater detail hereinafter. As soon as the inward flow has begun, there occurs an axial relative movement between the zone of disk 30 located outside a deflection zone 64 annularly surrounding the mandrel 58, on the one hand, and the zone thereof held between mandrel 58 and contact plate 60, including a portion representing the bottom 66 of the hollow body to be formed. Upon continuous further axial displacement, the material which continues to flow radially inward is continuously deflected by 90° in the deflection zone 64 through a short arc, it is applied against the cylindrical outside of mandrel 58, and it is thus formed into the cylindrical wall 68 of the resulting hollow body. FIG. 9 depicts an intermediate stage in the formation of this wall 68.

In the process of formation of the hollow body, there occurs a continual relative rotation between disk 30 including that portion thereof already formed as part of the hollow body, and the roll pair 342,362. In the embodiment shown in FIG. 9 and in the forms of the invention to be described hereinafter, and unless expressly stated otherwise, it may be assumed that the rolls are fixed with respect to their angular position in the circumferential direction of the axis of rotation 62, with the disk 30 being set in rotation.

This drive may take place via mandrel 58 or contact plate 60, one of these parts being driven by the spindle of a lathe or spinning machine, or by a drilling or milling machine, with the respective other part being supported, for example, by a tailstock spindle. The rolls 342,362 may be mounted freely rotatable and may be set into rotation on disk 30 by frictional engagement therewith. On the other hand, it is also possible to set into rotation at least one of the rolls 342,362 by means of a drive device and to rotate disk 30 about the axis of rotation 62, with mandrel 58 and contact plate 60 being mounted to be freely rotatable. Finally, in some cases to be discussed hereinafter, it is expedient to set the plate 30 into rotation through the mandrel 50 and/or the contact plate 60, but additionally to rotatively drive also at least one of the rolls 342,362 in order to reduce disturbing tangential forces exerted on disk 30 during its undular deformation and to avoid an otherwise existing tendency to form folds.

From their radially inner ends near the deflection zone 64, the rolls 342,362 extend radially outward far enough to receive them between the edge 32 of disk 30 at the original diameter thereof. In fact, although it has been stated that an undular defomation of the material plate in an annular zone of smaller radial width is sufficient to cause the material to flow radially inwardly, by such an extension of the rolls 342,362, formation of a fold is avoided and the flowing action is accelerated.

With the flowing of the material in the direction of the deflection zone 64, the edge 32 of disk 30 then migrates inwardly in nip 402 between the rolls 342,362.

Both rolls 342,362 have a body basically in the shape of a truncated cone, having formed therein wave loops and wave troughs equally spaced and revolving in spirals, so that the rolls have undular generatrices in any longitudinal section extending through their roll axes 70,72. Thus, roll 342 has at nip 402 convex wave loops 384 and concave wave troughs 385, while the generatrix of roll 362 at nip 402 is undular between wave troughs 484 and wave loops 485. The loops 384 of roll 342 are opposed to a trough 484 of roll 362 at nip 402. Preferably the rolls 342,362 are approximately relatively fixed at nip 402, so that the rolls 342,362 roll off material plate 30 in a relatively fixed arrangement.

The nip 402 extending along the original plane of the plate has a constant width over its entire length. Thereby the upsetting deformation of the material of disk 30 giving rise to an increase in thickness during inward flow of the material is avoided. The roll axes 70,72 of the rolls 342,362 meet the axis of rotation 62 at least approximately at the intersection of this axis with the original plane of the plate. More precisely, with greater thicknesses of disk 30, the intersections of the roll axes 70,72 should be displaced axially upwardly or downwardly relative to the original intersection by half the increase in thickness of disk 30, as seen in FIG. 9. Although the roll axes 70,72 are approximately perpendicular to the axis of rotation 62, they are, because of the basic form of the rolls 342,362 as truncated cones, inclined by approximately half the cone angle between these basic bodies and the original plate plane. This inclination becomes greater with larger diameters and hence larger selected cone angles of the rolls 342,362. Larger diameters and cone angles may be desirable when thicker disks 30 are utilized because, as viewed from the left in FIG. 9, a gentler entrance of the formed waves extending in the circumferential direction into the nip 402 will result. Nor is it necessary that the roll axes 70,72 intersect the axis of rotation 62 exactly at the plane of disk 30 since a slight deviation from such radial course can also serve to facilitate entrance of the waves into nip 402. The greater tangential forces then exerted by the rolls 342,362 on the disk can again be compensated by direct drive of at least one of the rolls 342,362. When seen in top view, the roll axes 70,72 may deviate somewhat from an exactly radial course and may not exactly intersect the axis of rotation 62 under all circumstances.

The rolls 342,362 are mounted for rotation in bearings which are arranged in mounting means at least one of which permits displacement at least approximately parallel to the axis of rotation 62, in such a way that at least one roll 342,362 of the pair is adjustable toward the other roll 362 or 342 of the same pair, thereby varying the width of the nip 402. This makes possible the initial insertion of the material plate or disk 30 between the rolls, and preferably by means of a corresponding setting drive the width of the nip 402 can be adjusted. Another expedient in the construction of embodiments according to the invention may provide for adjustability of at least one roll 342,362 at and away from the deflection zone 64 in the direction of the other roll 362 or 342 of the same pair with variation of the angle enclosed by the roll axes 70,72. Thus, unlike the arrangements illustrated, the nip 402 can be given a conical shape, apart from its undular course, which can be used to special advantage for producing a hollow body from a material plate 30 of a thickness greater than the thickness of wall 68 of the hollow body. Accordingly, with a given material consumption for the production of the hollow body, the original diameter of the material plate 30 can be reduced, and the radial length of the rolls 342,362 can be reduced as compared with a case where the width remains constant over the radial extent of the nip 402.

When using a material plate 30 of a thickness greater than the thickness of wall 68, the procedure preferably is to adjust the rolls 342,362 at first so that their spacing is greater at their ends away from the deflection zone 64 than at their ends toward the deflection zone 64. That is, the nip, apart from its waviness, tapers conically toward the axis of rotation 62. After the material plate has been inserted, the rolls 342,362 are adjusted toward each other while maintaining their angular position relative to the original plate plane, thus maintaining the difference of the spacings of their radially outer and radially inner ends, owing to which the disk 30 is first deformed only near the deflection zone 64, with the radially outer ends of the rolls 342,362 not as yet touching disk 30. Proportionately as the material of disk 30 flows radially inwardly and the diameter of disk 30 decreases, the disk is seized and shaped increasingly and finally over its entire radial extent by the rolls 342,362 which continue to be adjusted toward each other. In addition, during the outward flowing of the material of disk 30 from the radially inner end of nip 402 into the deflection zone 64, the angle enclosed by the roll axes 70,72 can be reduced. This angular displacement occurs expediently at a speed such that a deformation of disk 30 at its edge 32 begins before the latter has migrated radially inwardly by an appreciable percentage, e.g. 5% of the diameter of the disk. If a disk 30 is used whose original diameter is such that its edge 32 originally lies radially outside of the radially outer ends of the rolls 342,362, then the advance toward each other and/or the angular displacement of the rolls 342,362 expediently occurs at such a speed that their radially outer ends start the shaping of disk 30 just when the edge 32 comes to lie between these radially outer ends of the rolls 342,362 as it migrates inwardly.

When the material of disk 30 has flowed radially inwardly up to the deflection zone 64 and has traversed the deflection zone 64 with deflection into the axial direction, it forms against the outside of mandrel 58 as a wall 68. The thickness of wall 68 corresponds approximately to the thickness of disk 30 emerging from nip 402. The thickness of wall 68 can also be controlled by the axial relative velocity between mandrel 58, bottom 66 and contact plate 60 on the one hand and by the original plate plane, on the other. If this velocity is increased the material is reduced. Conversely, by a lower relative velocity an upsetting of the material in the deflection zone 64 and hence a thicker wall 68 can be obtained. During drawing, the deflection zone migrates in the drawing direction relative to the original plate plane, downwardly in FIG. 9. With upsetting this is not the case. Rather the deflection zone 64 arches counter to the relative axial displacement direction of mandrel 58, bottom 66 and contact plate 60 relative to the original plate plane. This phenomenon can be utilized to regulate the speed of the axial relative displacement of the bottom 66 — or generally of the zone of the material plate lying in the flow direction of the material beyond the deflection zone 64 — relative to the original plate plane, by measuring the axial location or height of the deflection zone 64 at a given radial distance from the axis of rotation 62. For this purpose FIG. 8 shows on the convex upper side of the deflection zone 64 a sensor wheel 75 whose axial position is communicated to a converter 78. Converter 78, held fixed in relation to the original plate plane, generates an output signal which is directly proportional to the axial position of the sensor wheel 76, or which, by averaging after at least one revolution of disk 30, corresponds to the mean height of the deflection zone. When, for example, the rolls 342,362 are held fixed in the axial direction and accordingly the original plate plane is fixed in the axial direction, the axial adjustment velocity of the mandrel 58 and of the contact plate 60 can be controlled by the output signal of converter 78.

For further improvement of the uniform application of wall 68 against the outside of mandrel 58, a rotatably mounted contact roller 80 is provided. Its axis 82 extends in a plane in common with the axis of rotation 62 inclined thereto in such a way that its edge, being closely adjacent on the side toward the axis of rotation 62 to the concave side of the deflection zone, rolls off on the outside of wall 68, while the edge of contact roller 80 has on its side away from the axis of rotation 62 a greater axial distance from the original plate plane. By radial displacement of the contact roller 80 toward or away from the axis of rotation 62, in addition to a smoothing, the thickness of wall 68 can be controlled and a smoothing effect can be additionally obtained. Bringing the contact roller closer to mandrel 58 causes rolling of the wall 68 being formed, thereby reducing its thickness and giving rise to stretching in an axial direction, which again can be compensated by appropriate speed in the axial relative displacement between bottom 66 and original plate plane. If desired, several additional contact rollers, arranged at preferably uniform angular intervals about the axis of rotation 62 in the same manner as the contact roller 80, may be provided, to keep the forces to be transmitted by the individual contact rollers small and to obtain as uniform an effect as possible. For an optimum smoothing effect on the outside of wall 68 it is advantageous to offset the individual contact rollers slightly in the axial direction to give their applied edges slightly different forms, and/or to give them additionally a smoothing profile which diminishes in the direction of material flow.

With respect ot their effect, the rollers 342,362 may be regarded as if they were composed of several roll sections freely rotatable relative to each other and lined up along the roll axes 70,72. Actually such a design is possible and in some cases even advantageous, as will be discussed hereinafter. Thus, for example, the roll section of roll 382 lying between successive wave troughs 385 may be compared with tool 341 in FIG. 6, and the wave loop 384 therebetween with its working face 381 (FIG. 5). Between the roll sections of roll 342 and of roll 362, therefore, there is formed along nip 402 a number of machining points evenly spaced radially, at which the circumferential point of disk 30 present in nip 402 is undularly deformed. Thus, in any radial location of edge 32 of disk 30 about the rotation thereof about the axis of rotation 62, mutually parallel waves extending in the circumferential direction are formed at or near the edge 32 as well as in the entire zone situtated radially inwardly to approximately the deflection zone 64. By this simultaneous multiple undular shaping the edge 32 is drawn in radially more than occurs with the shaping by means of a single pair of tools 341,361, with reference to FIGS. 5 and 6. In order not to hinder this drawing in of the edge 32 by the frictional force in nip 402, it may be expedient to adjust the rolls 342,362 at the start of the deformation of disk 30 in a slow movement toward each other until the ultimate inner width of nip 402 equals the original thickness of disk 30.

After formation in the disk 30 of waves extending in the circumferential direction, they must be transposed radially inwardly. For this, there are available in principle the possibilities already described with reference to FIGS. 7 and 8. The type of displacement used is evident from FIG. 10.

Figure 10:
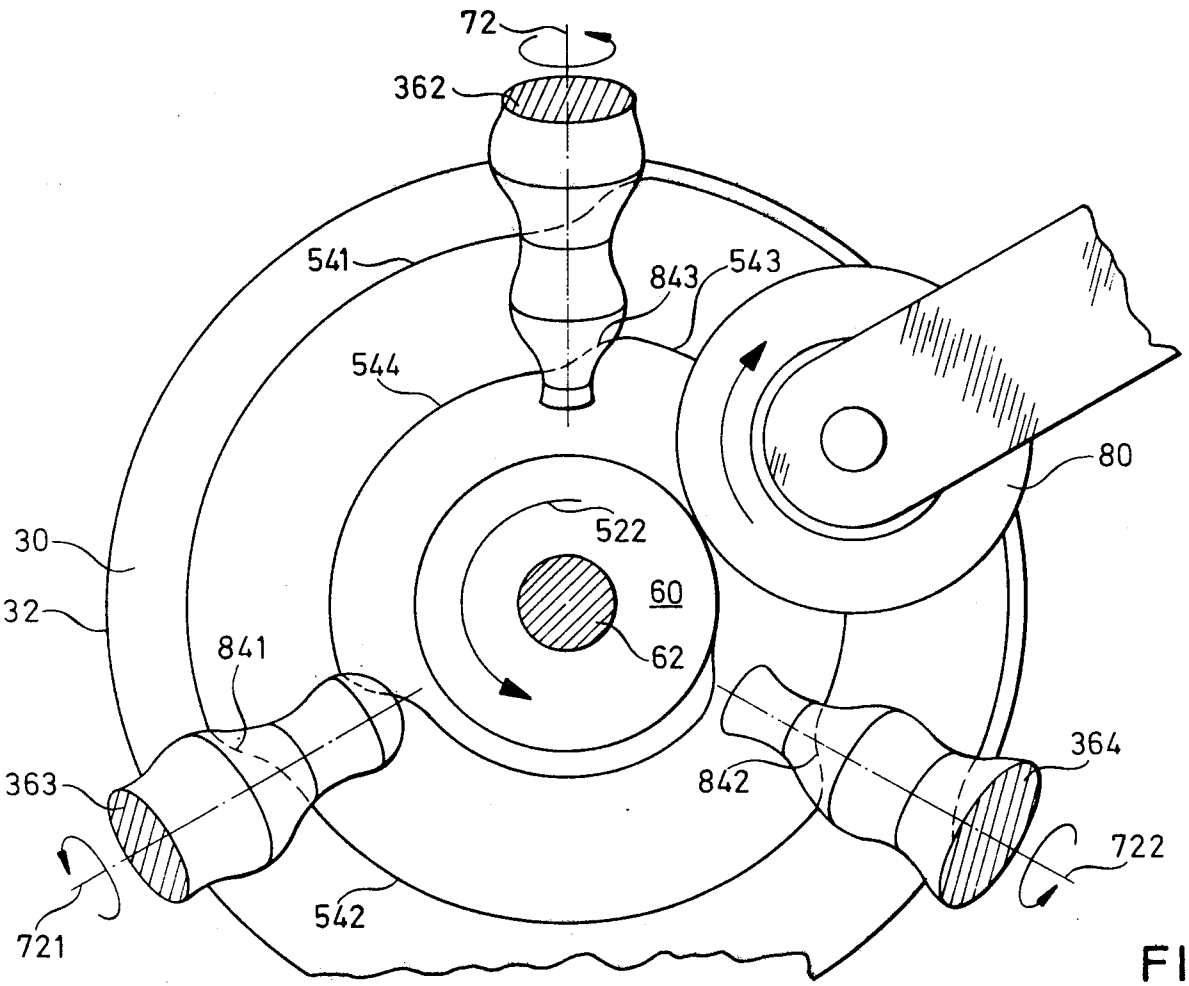
FIG. 10 is a view of the underside of the apparatus according to FIG. 9.

FIG. 10 shows a view of the underside of the apparatus according to FIG. 9. At the top of FIG. 10 is shown the roll 362, which is axially opposite the roll 342, not visible here since it is behind disk 30 (FIG. 9). Additionally two further roll pairs are provided having rolls opposite each other at a nip on both sides of disk 30 and having roll axes extending approximately radially relative to the axis of rotation 62. Of these only the rolls 363,364 with the roll axes 721,722 are visible. The rolls 362,363,364 are equally spaced angularly relative to the axis of rotation 62, so that their rotation relative to disk 30 occurs synchronously. In the embodiment shown the rolls 362,362,364 are mounted fixed with respect to angular rotation about the axis of rotation 62, while disk 30 and the hollow body formed therefrom is driven in rotation, this rotation occurring in the direction of the arrows 521 in FIG. 9 and 522 in FIG. 10.

The undulation of disk 30 as it exists from roll 352 can be seen in FIG. 10. Due to the pattern of the formed waves in the circumferential direction, wave crests, e.g. 541,544, evenly spaced in the radial direction and seen as lying in front of the plane of FIG. 10, alternate with wave troughs of disk 30 which lie behind the drawing plane.

The transposition of the waves may be regarded as proceeding, for example, from the wave crest 541 leaving roll 362. After one third of the revolution time of disk 30, calculated from the moment of undular deformation at roll 362, and after passing through an angle of 120°, a given circumferential point of the disk is again undularly deformed at roll 721 and the other roll axially opposed to it. Here, in fact, the wave crest 541 encounters a machining point which is offset by one third the wave length, i.e. of the radial distance for example between wave crest 541 and wave crest 544, radially inward relative to that machining point on roll 362 at which the wave crest 541 had previously been formed. Thereby wave crest 541 becomes wave crest 542 which lies one third the wave length farther inward radially. The transition 841 lying below roll 363 in FIG. 10 is indicated in broken lines. In a corresponding manner, a given circumferential point encounters, again after one-third the revolution period of disk 30 and after pressing through an angle of 120° on roll 362, a machining point again shifted radially inward by one-third the wave length, causing the wave crest 542 to change over into the wave crest 543 through the transition 842 indicated in broken lines. After another rotation of the circumferential point during one-third of the revolution period, roll 362 is again reached, with the machining point located there being again shifted radially inwardly by one-third the wave length relative to the previously traversed machining point at roll 364. Thereby, wave crest 543 is transformed into wave crest 544 at the transition 843. At a given circumferential point of disk 30, therefore, in steps succeeding each other in time, there occurs locally point by point a displacement radially inwardly, while the displacement in the circumferential direction is carried out continuously in time.

In a corresponding manner, as considered above with reference to wave crest 541, wave crest 544 is shifted radially inwardly step by step and after two such shifts reaches the deflection zone 64 (FIG. 9), where the material is deflected axially rearwardly out of the drawing plane in FIG. 10, to form the wall 68 of the desired hollow body.

With a design of the roll pairs according to FIGS. 9 and 10 and with roll axes 70, 72, 721, 722 intersecting the axis of rotation 62, it is not possible to operate with fewer than three roll pairs. When using two roll pairs, in fact, the transposition at both roll pairs would have to be equal to half the wave width, or with a roll pair a transposition by more then half the wave width would have to occur, which, as has been derived with reference to FIG. 8, is not permissible. When impinging on a machining point displaced by more than half the wave width but less than the full wave width relative to the preceding machinging point, the wave would be transposed radially outwardly, not inwardly. It is, however, possible to provide more than three roll pairs. When using four or five roll pairs, a shift by one-fourth or respectively one-fifth the wave width can then occur at each roll pair. When using six roll pairs, one has the choice to effect a displacement at each roll pair either by one-sixth or by one-third the wave width; in the latter case, the originally formed wave crest encounters after one full revolution of disk 30 the second next machining point lying radially inwardly as viewed from the original machining point. A larger number of roll pairs may be desirable to keep the shaping forces to be exerted at the individual roll pair small and/or to achieve rapid shaping. However, the form of the apparatus with three roll pairs shown in FIGS. 9 and 10 has the advantage of a relatively simple construction.

Figure 11:
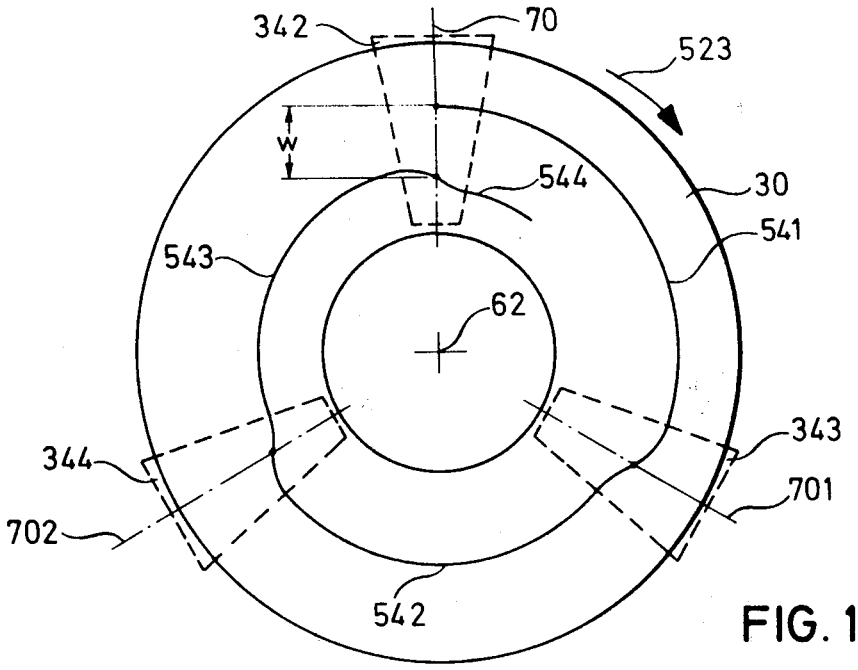
FIG. 11 is a schematic plan view of the apparatus according to FIGS. 9 and 10.

FIG. 11 shows a schematic top view of the disk 30 during the shaping operation in the apparatus according to FIGS. 9 and 10. The positions of roll 342 and of additional rolls 343,344 with respective roll axes 70,701,702 are indicated in broken lines, which are axially opposite the rolls 362,363,364 (FIG. 11). Disk 30 is rotated through the nips of these roll pairs in the direction of arrow 523. To illustrate the transposition of the wave by one wave width w during one revolution there is shown only the sequence of wave crests 541 to 544, which, however, must be imagined as wave troughs lying behind the drawing plane when looking into disk 30.

Figure 12:
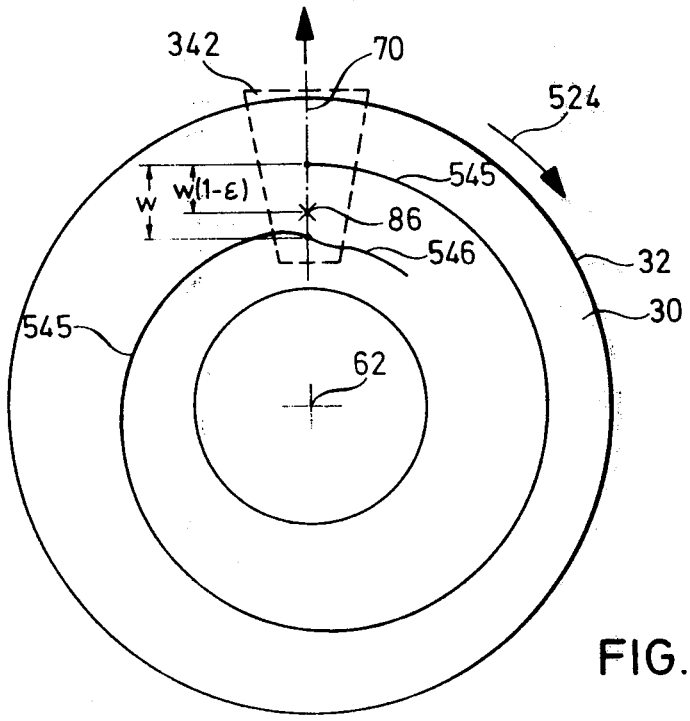

FIG. 12 shows a schematic top view of disk 30 similar to FIG. 11, for shaping in an apparatus according to FIG. 9, but which comprises a single pair of rolls opposing each other at the nip. The location of roll 342, lying in front of the disk in the figure is indicated in broken lines, while the roll 362 opposite it (FIG. 9) is not shown.

Upon rotation of disk 30 in FIG. 12 in the direction of arrow 524, approximately parallel wave troughs 545,546 emerge from machining points under roll 342. At the same time, roll 342 together with the further roll 362 forming a roll pair therewith (FIG. 9) is displaced radially outwardly while maintaining the width of the nip 402 (FIG. 9). At earlier stages in the performance of the process, the machining point forming the wave trough 545 has a smaller distance from the axis of rotation 62. This means that wave trough 545 extends in a spiral formation. It can be concluded from the radial position of wave trhough 545 just before its entrance into the zone of roll 342 from the right, as viewed in FIG. 12, that the upper machining point from which the wave trough extends rightwardly has at a point preceding the point under consideration by the duration of one revolution of disk 30, a location indicated at 86. The machining point, therefore, had been displaced radially outwardly during the period of one revolution of disk 30 by a distance w (1 − epsilon), which is less than the wave width w and greater than half its width. This displacement shifts the wave trough 545 radially inwardly as it enters under roll 342 from the left, in order then to change over into the wave trough 546.

Instead of a displacement of rolls 342, 362 radially outwardly, it is possible to displace them radially inwardly, and this may occur during a revolution of disk 30 by a distance which is smaller than half the wave length w. Although with the process described with reference to FIG. 12 waves are formed which start near the deflection zone 64 (FIG. 9) and which move slowly outwardly in a spiral with a directional component extending predominantly in the circumferential direction and with a smaller radial component, with the opposite direction of displacement of the roll pair the wave would start toward edge 32 of disk 30 and would extend with a small radially inward directional component spirally toward the deflection zone 64. In any case, for the radial displacement of the roll pair the conditions derived in the disclosure with reference to FIG. 8 apply as well as the possibilities relevant to the case of continuous displacement described with reference to FIG. 7.

The radial shifting of the roll pair, commensurate with shifting of the roll 342 in FIG. 12, either radially outwardly or radially inwardly, can occur only through a relatively small total distance. If the rolls are shifted too far out, their radially inner ends will be too far removed from the deflection zone 64 (FIG. 9) to ensure the flow of the material of disk 30 to that zone. On the other hand, with displacement of the roll pair radially inwardly, at least one roll can be displaced not farther than the deflection zone 64 because then the roll touches the hollow body to be formed. To remedy this situation, the roll pair can be displaced in one radial direction, whereupon it is lifted off disk 30, displaced counter to the previous direction of displacement, and again placed on disk 30. With proper synchronization with the period of revolution of disk 30, after radial displacement of the machining point formed between the roll pair by a distance which corresponds to the radial mutual spacing of the machining points, the front machining point in the direction of displacement is abolished and a new machining point is formed behind the last machining point in the direction of displacement. If desired, the transposing action occurring counter to the shift direction can be used to achieve a transposition of these waves radially inwardly, as has been previously explained in principle with reference to FIG. 8. This may occur when both rolls are again placed on disk 30, and would not involve a meshing of the waves thereof, but a suitable displacment of the roll pair. In connection with FIGS. 9 to 11, it has been shown that with the roll form used and with the indicated arrangement of the roll axes 70, 701, 702, 72, 721, 722 that intersect the axis of rotation 62, at least, and preferably, three roll pairs 342, 362; 343, 363; 344, 364 are necessary. FIG. 13 depicts a possibility whereby this requirement can be circumvented.

FIG. 13 is, like FIGS. 11 and 12, a schematic top view of disk 30 during the shaping operation. At opposed circumferential points on disk 30, two diametrically opposed roll pairs are provided, only the rolls 345, 346 being shown in broken line. The rolls are slanted at an acute angle relative to the radial direction indicated by the line 88. The roll axes such as for example roll axis 703 of roll 345 and roll axis 704 of roll 346, extend at equal distances on opposite sides of the axis of rotation 62. Preferably, roll axis 704 extends parallel to the roll axis 703 of the opposed corresponding roll pair including roll 345.

If roll 345 were not set obliquely, a wave trough 545' extending in the circumferential direction around the axis of rotation 62 would emerge under roll 345 when disk 30 rotates in the direction of arrow 525. Due to the slant of roll 345, however, the formed wave trough 545 is forced, after leaving the point of the machining area lying under the roll axis 703, to extend at first normal to the roll axis 703 and then radially inwardly for a small displacement path. It is possible, therefore, to obtain at the next roll pair comprising roll 346, by transposing by less than half the wave width, a total transposition by one-half the wave width. This is facilitated also by the fact that upon running in under roll 346, because of the oblique position thereof, a similar directional effect is obtained as in the running out under roll 345, owing to which a stronger transposing is possible than would be the case if roll axis 704 extended through the axis of rotation 62. After wave trough 545 has thus been transformed into a wave trough 546, it too is displaced by one-half the wave width, in that when running out under roll 346 it is shifted radially inwardly by a small distance and then caused to undergo the remaining displacement which will be somewhat smaller than one-half the wave width, when running in under roll 345. Thus transformation of wave trough 545 into wave trough 547, i.e., a displacement by one wave width, is obtained in a single revolution of disk 30 using only two roll pairs.

The rolls used in FIG. 13, including rolls 345, 346, may be designed as in the embodiment according to FIGS. 9 to 11 in such a way that the highest or respectively the lowest points of the wave loops and wave troughs of their generatrices lie on circles whose plane is normal to the wave axis. The oblique position, however, can be employed successfully also with other roll forms, as will be described hereinafter with reference to FIG. 14 and in processes differing from those previously described. It is, of course, possible also to provide, instead of the roll pairs used in FIG. 13, more than two such roll pairs. Also it may suffice, when two or more roll pairs are provided, to arrange only one of these roll pairs in the oblique orientation previously described.

Figure 14:
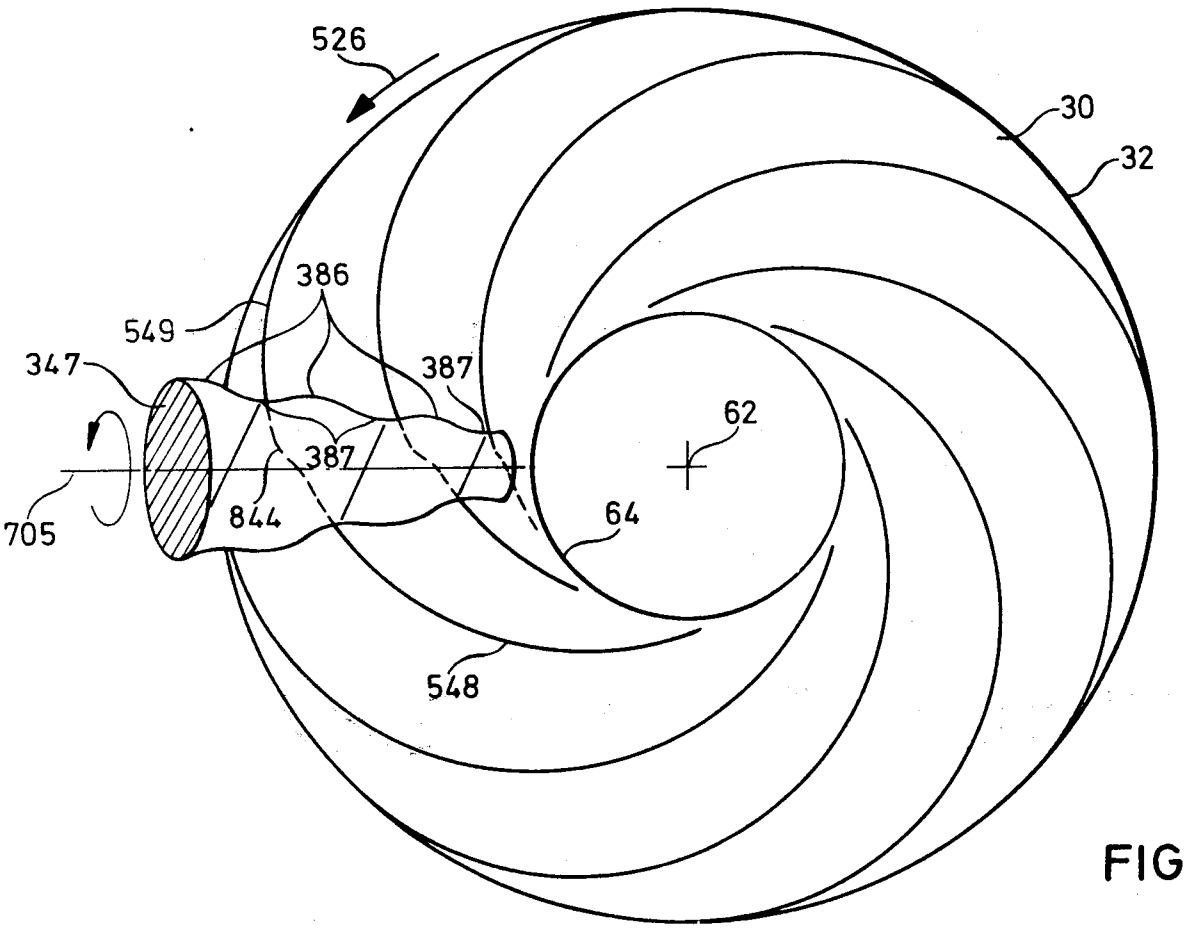
FIG. 14 is a top view of another apparatus for producing hollow bodies having a worm type roll pair.

FIG. 14 shows diagrammatically, with parts not required for explanation omitted, the top view of another apparatus for producing a hollow body utilizing a single roll pair, with only roll 347 and its roll axis 705 being shown, an additional roll opposite thereto at the nip not being shown. For the position of the two rolls, each having a frusto-conical body, the disclosure set forth in conndection with FIGS. 9 and 13 essentially applies. However, as is apparent at roll 347, the rolls have wave loops 386 and wave troughs 387 of their generatrices extending along helical lines. These form a single-groove conical screw thread or worm thread, although in principle a double or multiple thread is possible also. The two rolls of the roll pair have oppositely extending helical lines; the helical lines of roll 347 forming a left-hand thread, while the opposite roll of the pair has a right-hand thread.

As disk 30 rotates about the axis of rotation 62 in the direction of arrow 526, the rolls of the roll pair roll off disk 30 and effect undular shaping thereof. Furthermore as in the embodiment according to FIGS. 9 to 11, disk 30 may be driven and/or the rolls may be driven. The machining points formed in the nip between the rolls, spaced from each other by the wave width, migrate in the radial direction, radially outwardly. Due to the spiral or worm form of the rolls, for example of roll 347, and without any radial displacement of the rolls, it is possible after the radial displacement of the machining points by a distance which corresponds to the radial mutual spacing of the machining points, to achieve abolishment of the front machining point in the direction of displacement with a new machining point being formed in the direction of displacement behind the last machining point. Further, by the displacement of the machining points, the formed waves extending with a circumferential direction component, e.g. wave 548, are formed to run spirally. The undular shaping is begun near the deflection zone 64 and is continued through to the edge 32 of disk 30 because of the radial displacement of the machining point.

If an imaginary orbit at any distance from the axis of rotation 62 on disk 30. e.g. the circle formed by the edge 32, will have a circumference which is an integral multiple of the circumference of the rolls rolling off on the same orbit, e.g. roll 347. Then, after a full revolution of disk 30, roll 347 would mesh with the same waves that had previously been formed by it in disk 30. In this way a radial transposition of the waves once formed toward the deflection zone 64 would not be attainable. In principle it would be possible to achieve this transposition by means of additional roll pairs by an approach similar to that disclosed with reference to the embodiments according to FIGS. 9 to 11 and 13. In the instant embodiment, however, the same roll pair which forms the wave serves also to effect their repeated radial transposition. This is achieved in that the circumference of the rolls, e.g. of roll 347, rolling off on a given orbit of disk 30 about the axis of rotation 62 is selected so that the orbit is not an integral multiple of this roll circumference. Thereby a wave entering under roll 347, for example the wave crest 549, encounters a machining point radially displaced and is transposed in the radial direction. Thus the wave crest 549 changes over in a transition 844 at the machining point into the wave crest 548 emerging under roll 347. At a given circumferential point of disk 30, a wave is thus transposed inwardly step by step after each revolution of disk 30. The transposition occurs practically point by point at the rolls held fixed with respect to the angular position to the axis of rotation 62, but continuously in the circumferential direction and along the waves.

Figure 15:
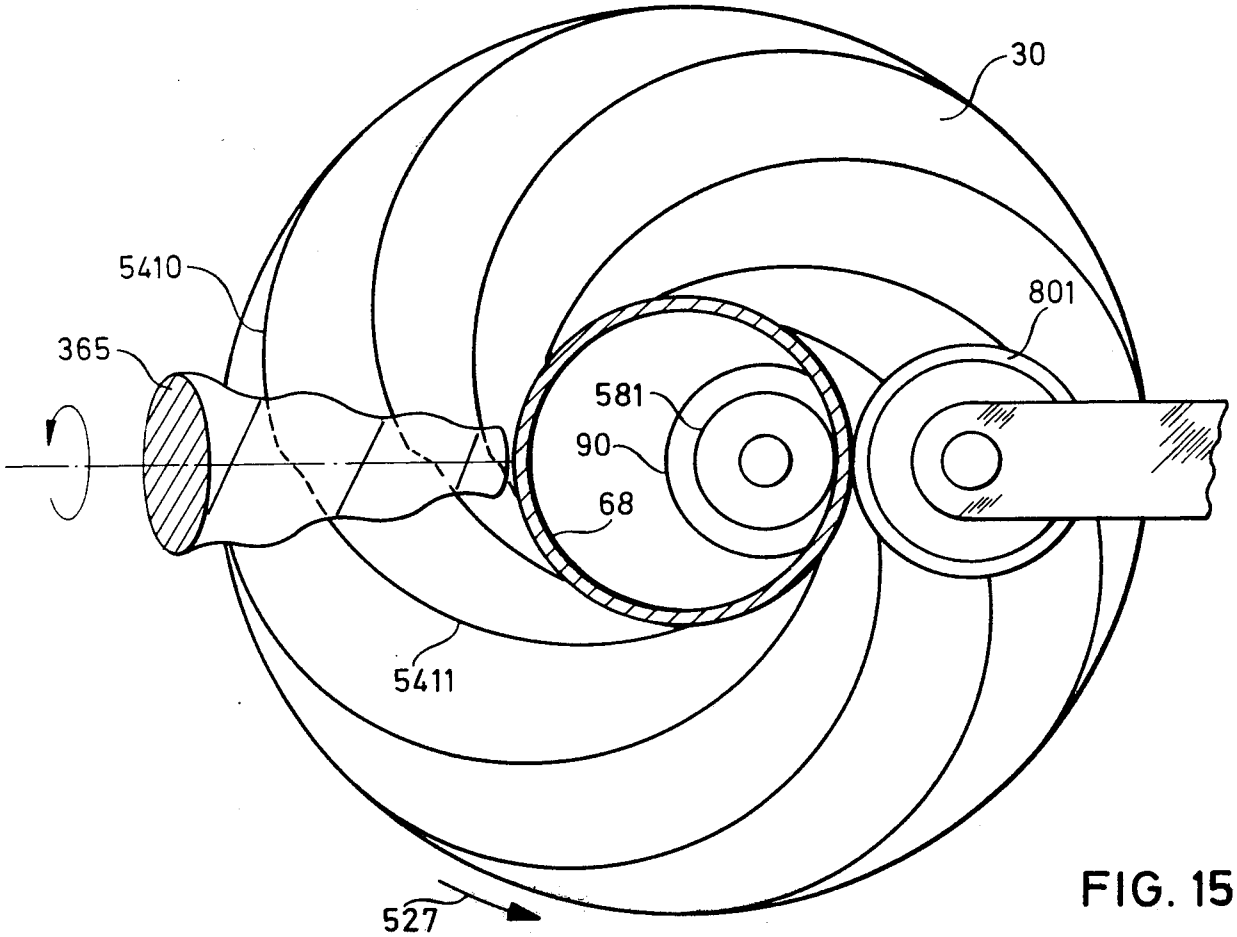
FIG. 15 is a view of the underside of an apparatus likewise comprising a single worm type roll pair.

FIG. 15 shows a further apparatus which, like that according to FIG. 14, is seen from below and comprises a roll pair with a worm thread, of which one roll 365 is represented. Unlike the embodiment according to FIG. 14, where the roll lying on the underside of disk 30 in FIG. 15 has a right-hand thread, roll 365, lying below the disk and in front of it, is provided with a left-hand thread. Here again, by giving the respective circular line of disk 30 a dimension differing from an integral multiple of the circumference of roll 365, a transposition of the waves radially inwardly is achieved, as can be seen for example in the course of the wave crest 5410 entering under roll 365, which by a machining point displaced radially inwardly is transformed into the wave crest 5411 coming out under roll 348, while disk 30 rotates in the direction of arrow 527.

The bottom 66 (FIG. 9) of the hollow body to be formed, which would lie in front of the drawing plane of FIG. 15, is here cut away, as are also any elements seizing it and pulling it out of the original plate plane. This makes visible a roll chuck 581, which is shown also in the partial representation of FIG. 16 showing an axial section through the apparatus according to FIG. 15. The deflection of the material which at first flows in the original plate plane of disk 30, into the axial direction, to form the wall 68, is effected in the embodiment by application againt a generatrix of the roll chuck 581. The latter rolls off on the inside at a circumferential speed equal to the circumferential speed of the inside of wall 68. Its diameter is smaller than the diameter of wall 68. To avoid arching of the deflection zone 64 counter to the flow direction of wall 68 relative to the original plate plane, the roll chuck 581 comprises at its upper end an annular flange or edge 90 adjacent to the convex side of the deflection zone 64, this edge having a diameter larger than the outside of the roll chuck 581 and merging therewith through a rounded portion.

In principle, various kinds of chucks may be used for deflecting the material initially flowing radially inwardly and for the formation of the wall of a hollow body, such chucks being known from the metal spinning arts. Also the mandrel 58 shown in FIG. 9 forms such a chuck, and it is obvious that it could replace a roll chuck of a type similar to to chuck 581 (FIGS. 15, 16) or, for example, a template rapidly revolving about the axis of rotation 62 and extending radially outwardly. Analogously, the roll chuck 581 could be replaced by other chuck constructions.

The axial length of the roll chuck 581 is substantially shorter than the desired axial length of wall 68 of the hollow body. This length is sufficient for the deflection of the material and for the smoothing of the outside of wall 68 by means of the contact roller 801. As the roll chuck 581 rolls off on the inside of wall 68, the latter can readily move off the outside of roll chuck 581 axially without being hindered by the fact that the roll chuck is fixed in an axial direction relative to the original plate plane. If desired, however, a slight axial mobility of roll chuck 581 may be permitted, and the latter can be pressed onto the deflection zone 64 under slight initial tension. Owing to this, the roll chuck 581 follows axial movements of the deflection zone 64 and they, instead of the axial movements of the sensor wheel 76 in FIG. 9, can serve to control a converter 78 and to generate a measuring signal, as a function of which a regulation of the axial relative velocity between the bottom 66 (FIG. 9) of the formed hollow body and the original plate plane takes place.

In both embodiments shown in FIG. 14 or respectively in FIGS. 15 and 16, the circumference of the rolls, e.g. rolls 347, 365, must be appropriately selected to achieve, during the rolling off of this roll circumference on an imaginary circular line, that the latter is an odd multiple of the roll circumference, in order thereby to make possible a transposition of the waves radially inwardly. This is in accordance with what has been previously described. In practice, this choice of roll circumference can be made in the simplest manner by displacing the rolls in the radial direction. If, for example, roll 365 in FIG. 15 is displaced radially outwardly, increasingly smaller circumferences of roll 365 will come into engagement with the orbit formed by edge 32 of disk 30. By such a displacement, moreover, it becomes possible to control through the intensity of the respective displacement of the waves also the intensity of the undular deformation of disk 30. If there occurs a radial adjustment of the rolls to the extent that a wave encounters after one revolution of disk 30 a machining point shifted by one-half wave length, then, just as with a mere meshing of the rolls with the waves (displacement by the amount zero) no flow of material in the radial direction will occur, and with still greater displacement of the machining point between successive passes of the same circumferential point of a wave the latter is now shifted outwardly instead of radially inwardly. The material of disk 30 then strives to flow outwardly along the original plate plane.

The above reasoning shows also that in principle it is possible by the method according to the invention to form hollow bodies whose diameter is greater than or equal to the original outside diameter of the plate used. Since, however, a flowing of the material from the center of a plate in different radial directions can be achieved only to an extremely small degree, it is then expedient to facilitate the radial outward flow by using a plate which has a central, preferably circular, opening. The material having flowed to the edge of the plate can then be deflected there in a deflection zone at an angle to the original plate plane and it may be caused to flow away from the original plate plane while forming the wall of the hollow body, it being applied for example against the inner circumference of a tubular chuck revolving jointly with the plate and continuously displaced axially together with the formed hollow body wall. Also when the rolls are arranged according to FIGS. 11 to 13, the material can be caused to flow radially outwardly along the original plate plane, by changing the sequence of the rolls or reversing the direction of the relative rotation between the plate and the machining points at the rolls. In the case of undular shaping according to FIG. 12 the speed of the radial displacement of the roll pair can also be changed so that the material of the plate flows outwardly. Especially good results have been achieved with the process according to the invention when by means of the devices described hollow bodies were produced whose diameter was smaller than the original diameter of the plate used, so that the material thereof had to be caused to flow inwardly along the original plate plane.

In the embodiment, shown partially in section in FIG. 17, the material of a plate 301 is in a manner similar to that described with reference to FIG. 9, caused to flow radially inwardly in a deflection zone 64, to form the tubular wall 681 of the hollow body. The deflection is carried out by means of a hammer 92, which is caused by means of a swinging drive 94 to deflect a deflection zone 64 in rapid succession from its convex outer side, the point of the deflection zone 64 running under the hammer 92 being supported by a contact roller 802 firmly mounted which, like the contact roller 80 (FIG. 9) is inclined but at a somewhat steeper angle. Hammer 92 has a form adapted both to the convex rounding of the deflection zone 64 and to the concave rounding of the inside of wall 681 and is driven by the swinging drive 94 with such force that the wall 681 emerging from the gap between hammer 92 and contact roller 802 has the desired thickness. This thickness can be controlled by varying the power supplied to the swinging drive 94 and hence to the hammer 92.

In all embodiments, the deflecting in the deflection zone 64 can take place with a variety of suitable tools, not only by means of mandrel 58 and contact roller 80 (FIG. 9) and by hammer 92 and possibly contact roller 802 (FIG. 17), but for example also by a grooved roller rolling off on the convex side of the deflection zone 64.

It can be seen in FIG. 17 that originally the material plate 301 had the form of a plane plate with a central opening 96. The use of such plates is favorable when the desired hollow body is not intended to have a bottom. Opening 96, however, has a slightly smaller diameter than the deflection zone 64, so that a region of the original material plate 301 lying inside the deflection zone 64, i.e., the present edge 98, can be seized between the contact plate 60 and a ram 100, be pulled away axially from the original plate plane, be guided to a radial displacement relative to the axis of rotation 62, and be driven in rotation if desired. It is clearly seen from the embodiment depicted that the operation of ram 100 is independent of that of hammer 92 or of another tool provided for the deflection of the material with formation of the hollow body wall. Thus, for example, in the embodiment shown in FIG. 9, when using another chuck instead of mandrel 58, an additional ram, possibly passed coaxially through this chuck, might be provided.

In the process according to the invention where a region of the material plate lying beyond the deflection zone 64 with respect to the flow direction of the material is drawn out of the original plate plane, this always occurs with so small a tensile force that tensile stresses thereby exerted on the deflection zone 64 would by themselves never cause flow of the material in the deflection zone 64. The material flow through the deflection zone 64 is due to the fact that it is caused to flow by means of the rolls initially in the original plate plane upstream of the deflection zone 64. The extraction from the original plate plane is for the sole purpose of influencing the direction of the material flow into the deflection zone 64 and through it in such a way that the deflection zone 64 maintains a predetermined axial position relative to the original plate plane. Further, it is to axially guide the material emerging from the deflection zone 64 and forming the wall, e.g. 681, against radial deflection in such a way that no accumulation of material occurs in the deflection zone 64.

In principle, the process according to the invention can be carried out without extraction from the original plate plane of a region of the plate lying with respect to the flow direction of the material in the original plate plane beyond the deflection zone 64, i.e., in FIG. 9 the bottom 66 and in FIG. 17 the edge 98. In fact, once the material flowing in the original plate plane to the deflection point 64 has been deflected and forms, for example, the wall 681 (FIG. 17), then, without further intervention, the free end thereof moves away from the original plate plane in proportion as additional material flowing radially inwardly to the deflection point 64 flows through the same, is deflected, and thus continuously lengthens the wall 681. If then, for example, the shaping of plate 301 occurs with the use of the roll pair shown in FIGS. 9 and 10 and these rolls are driven in rotation, the contact plate 60 and the ram 100 can be omitted altogether. For radial guiding there may be provided in that case, if necessary, a simple ring 110, indicated in FIG. 17 in broken lines, surrounding the wall 681, the ring being fixed or rotating together with wall 681.

For various purposes it may be expedient, with the apparatus described herein, to effect material flow toward the deflection zone 64 with different intensity with regard both to time and possibly also to location within the material plate 30, 301, from which a significantly different undular deformation may take place. This is possible in various ways. Referring to FIGS. 14 and 15 it has been shown that a radial displacement of the roll pair leads to different deformation. In one extreme case, in which the machining points undergo no displacement between successive revolutions of the disk or material plate 30, the rolls mesh with the waves, so that no displacement occurs. The other extreme case consists in that the displacement of the machining points occurs by one-half wave length or more, so that the wave crests are alternately transformed into wave troughs and back, without material transport occuring, or without even a reversal of the flow direction occurring. The transposition of the machining point exactly by one-half wave length brings about, as it were, a wave interference with extinction with respect to the flow of the material. Similar considerations apply also in the embodiments according to FIGS. 9 to 11, 12 and 13. For example, in FIG. 11 the roll 342 can be retained radially, roll 343 being displaced slightly radially outwardly and roll 344 being shifted radially outwardly by double the displacement path of roll 343. This results, at simultaneous corresponding displacement of the respective roll of the same pair, in a reduced transposition of the waves in the radial direction and thereby a reduced material transport. Also, in this case, interference can be produced when a single one of the wave pairs is displaced relative to the preceding pair in the direction of rotation of disk 30 to such an extent that the wave encounters at the displaced wave pair a machining point offset by one-half wave length. Similar considerations regarding the interference apply in the embodiment according to FIG. 13, where, because of the relatively strong transposition of the wave at each roll pair, the displacement of a roll pair by only a small distance radially inwardly is sufficient to suppress the flow of the material. In the embodiment according to FIG. 12, the control of the material transport can be effected by differing rates of speed at which the roll pair comprising roll 342 is displaced in the radial direction.

Another possibility, applicable in all embodiments, involves making the flow of material different in intensity consisting in that the working faces of the tools used are pressed in at the machining points with different intensity at different times. That is, when rolls are used, they may be moved toward or away from the nip more or less thereby varying the size of the nip. If the tools 341, 361 in FIG. 5 are considered to be rolls, it can readily be seen that the distance of the wave crest 381 of one roll 341 from the wave trough 421 of the other roll 361 opposite this wave crest 381 can be made at the most equal to the height of wave crest 381 above a wave trough of the generatrix of the same roll 341 plus the thickness of plate 30 until the flow of material disappears. A phenomenon comparable to the above described interference does not occur, however.

Another possibility of influencing the intensity of the material flow is to vary in time the relative velocity between the plate and the machining point or points. It can readily be seen that, in the case of roll pairs angularly retained with respect to the axis of rotation 62, the material flow decreases with decreasing speed of rotation of the disk or plate. This relative velocity can, of course, be varied also by additionally rotating the roll pairs in or counter to the direction of rotation of the plate while the plate revolves in the circumferential direction. Thus, in the top view according to any of the FIGS. 11 to 14, for example, the angular position relative to the axis of rotation 62 varies.

In the apparatus according to FIG. 13, interference can be produced in a simple manner also by turning back at least one of the two roll pairs by rotation about vertical axes parallel to the axis of rotation 62. This can be done in such a way that the roll axes, e.g. 703, 704, intersect the axis of rotation 62.

The differences in undular shaping may serve for example to produce a hollow body of different wall thickness along its axis of rotation. In this case, the greater or lesser deformation will be maintained over several relative rotations between material plate and machining point or points. To obtain a soft transition between wall portions of different thickness at axially different points, the displacement of the roll pairs leading to different deformation will also be effected with a time constant which is a multiple of the duration of one relative rotation.

If control of the intensity of the material flow is carried out cyclically at least once during each revolution of the plate, there can be obtained a variation of the wall thickness in the circumferential direction, particularly if the cross-section of the formed hollow body is circular. In the case of hollow bodies whose cross-section differs from the circular form the thickness of the wall may be made equal to that of the other circumferential points by an increased material inflow at certain circumferential points.

To produce varying deformation of the material plate at given circumferential points there may be used also a special form of at least one roll pair. Although here, in a manner approximately similar to that of FIGS. 9 and 10, the rolls have annularly circling wave loops and wave troughs, the highest and lowest points of the wave loops and wave troughs lie on curves whose planes extend obliquely to the wave axis. Such a roll pair produces in the revolving plate a family of waves extending alternately radially inwardly and radially outwardly in wave or zig-zag form. These waves, therefore, are transposed more or less strongly in the radial direction at a following machining point, depending on their instantaneous radial location, and they also may be subject to interference in the circumferential direction from place to place.

Furthermore, with the apparatus described, it is possible also to produce hollow bodies whose cross-section differs from the circular form at at least one axial point. For this purpose, an appropriately formed chuck may be used such as the roll chuck 581 shown in FIGS. 15 and 16. In the simplest case a chuck designed as a barrel type roller is displaced in an at least approximately radial direction cyclically and synchronously with the rotation of plate 30. For example, the mandrel 58 shown in FIG. 9 may be replaced by a chuck which presents a bulge at a given circumferential point. The contact roller 80 and possibly the wheel 76 must then be cyclically displaced in a radial direction according to the form of the bulge. This is made possible, in a known manner, by means of a mechanical or other cam control. In the apparatus shown in FIGS. 16 and 17, the roll chuck 581 and the contact roller 801 can be radially displaced jointly to form a bulge. In a corresponding manner any other desired cross-sections, e.g. elliptical, kidney-shaped or egg-shaped, can be formed. Likewise it is possible in this manner to form a cross-section which resembles the circular form at least approximately, but whose cross-sectional center of gravity is offset relative to the axis of rotation. Thus, for example, an essentially cylindrical pipe may be manufactured with a bulge on a portion of its axial length or extending along a helical line.

If the deviation of the cross-section of the formed hollow body from a circular shape concentric to the axis of rotation 62 is insignificant, it may suffice to maintain the radial position of the roll pair or pairs. It then suffices to provide the rolls to extend radially inwardly only so far that with the passage of the point of greatest distance of the hollow body cross-section from the axis of rotation they also will still permit unhindered passage of the deflection zone surrounding the cross-sectional form. In most cases, however, it will be desirable to also cyclically control all rolls according to the respective distance of the deflection zone from the axis of rotation. The control can take place in the same manner as that of the contact rollers 80 (FIG. 9) or 801 (FIG. 15), but it is of course easiest in embodiments with a single existing roll pair.

If the cross-section of the hollow body differs to a relatively significant degree from a circular form, it may be desirable to use a plate whose original shape approximately resembles the cross-section of the hollow body to be formed. In any event, in the process of the invention it is possible also to use plates whose outer edge has a form differing from a circular form.

In a manner similar to that occurring when producing a hollow body having a cross-sectional form differing from a circular form and/or which is eccentric, radial shifting movements may occur when producing a hollow body with different inside widths taken in the axial direction. In this case the shift movements simply occur at slower speeds, so that the displacement process extends over several relative rotations between the plate and the machining points. For example, it can be seen with reference to FIG. 15 that when the diameter of the wall 68 is to be increased at any axial point of the formed hollow body, the roll chuck 581 and contact roller 801 are jointly displaced to the right, while the roll pair with roll 348 must be displaced to the left. These relatively slow shift movements are superposed, when the shape of the wall 68 differs from a circular form, on those radial shift movements which are carried out to obtain the desired shape, as above. If enlargements and constrictions of the formed hollow body lie relatively close together in the axial direction, it can be seen from FIG. 16 that then the roll chuck 581 must have a very small axial length in order not to pull the already formed hollow body wall outwardly by its lower end during the radially outward displacement. In this case it may therefore be desirable to replace the roll chuck 581 by a roller which is opposed to the contact roller 801 at the contact point, and is possibly likewise set obliquely.

If in the embodiment according to FIGS. 9 to 11 the roll pairs and the contact roller 80, as well as a roll chuck optionally provided as in FIG. 15, are displaced radially to obtain a different inside width of the hollow body, the material flow radially inwardly will remain approximately constant, and through speed control by the radially displaced wheel 76 the thickness of the wall of the formed hollow body also remains at least approximately constant. If a speed control is not provided, however, it may be desirable to increase the material flow upon displacement of the roll pairs radially outwardly, so as to obtain a uniform wall thickness at constant relative velocity of bottom 66 relative to the original plate plane 46. This is similarly applicable to an even greater degree to the embodiments according to FIGS. 14 and 15, because there the material flow decreases radially inwardly upon radial displacement of the roll pairs. In these cases, constant wall thicknesses can be effected by increasing the speed of rotation of disk 30 with displacement of the roll pairs radially outwardly and by decreasing the speed of rotation with the opposite displacement.

Figure 18:
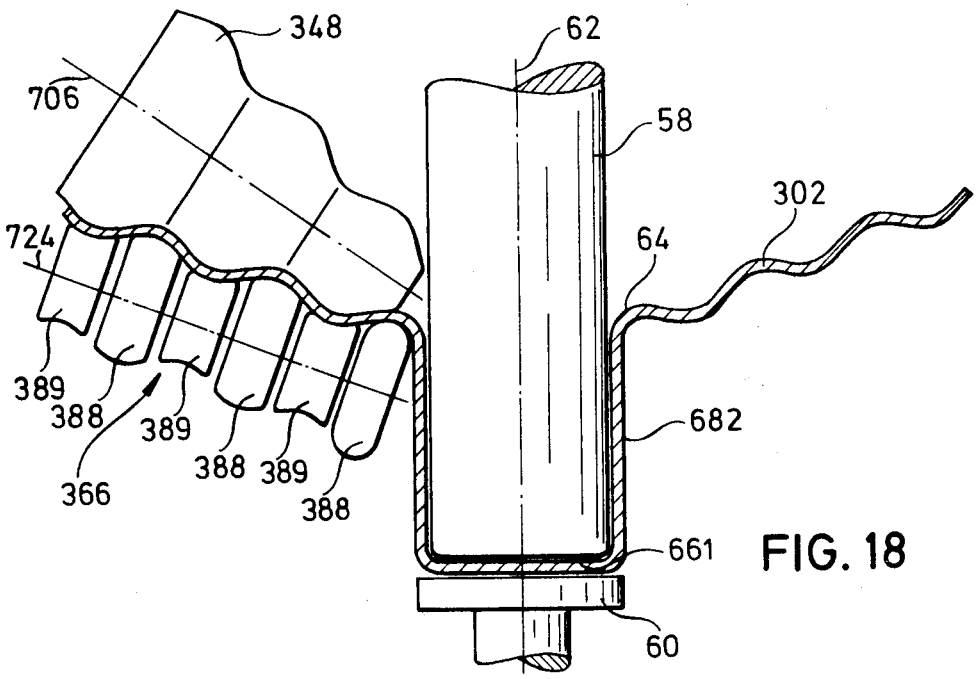
FIGS. 18 and 19 are sectional views showing two devices where the production of hollow bodies occurs without the contact roller used in other embodiments.

FIG. 18 shows a modification of the apparatus according to FIGS. 9 to 11, 12 or 13, wherein a conical plate 302 is shaped into a cylindrical beaker type hollow body having a wall 682 and a bottom 661. Each roll pair consists of an upper roll 348 having a frusto-conical body and generatrices with wave loops and wave troughs the highest and lowest points of the wave loops or wave troughs lying in circles whose plane is normal to the wave axis 706. As in the embodiment according to FIGS. 9 to 11, the wave axis 706 can intersect the axis of rotation 62 or, as in the embodiment according to FIG. 13, it can be set obliquely relative to a radial course and be spaced a certain distance from the axis of rotation 62.

The other roll 366 forming a pair with roll 348 is composed of several wave loop sections 388 and wave trough sections 389 fitted together along the wave axis 724 and rotatably mounted independently of each other, each wave loop section 388 being succeeded by a wave trough section 389. Due to this design, the individual sections 388, 389 can roll off on the underside of plate 302 at a respective circumferential speed thereof, without the need for the roll 366 to have a frusto-conical shape tapering toward the axis of rotation 62. Instead, the diameter of the successive wave trough sections 389 and loop sections 388 increases toward the axis of rotation 62, so that roll 366 corresponds in its basic form to a frustum whose base points toward the axis of rotation 62. As a modification of FIG. 18, roll 366 could have a basic cylindrical form. This would have the advantage that is could be composed of identical wave loop sections 388 and identical wave trough sections 389. Another favorable possibility, in addition to the subdivision into sections applicable in the embodiments according to FIGS. 9 to 12 and 18 for compensating different circumferential speeds of the material plate 30 or 302, consists in forming at least one roll of a pair with an elastically flexible rubber composition. Thus, for example, in FIG. 9 or in FIG. 18, both rolls 342, 352 or 348, 366 or only one of these rolls may have an elastic rubber jacket, which of course would have to be rigid enough to bring about the desired undular shaping despite its resilience. If one of the rolls is made of metal or other firm material and the other roll of the same pair of a rubber or elastic material at least in its jacket, it is even possible to form these elastically flexible rubber rolls without wave troughs or wave loops entirely in frusto-conical or cylindrical form, which has the advantage of easy manufacture.

In the apparatus according to FIG. 18, roll 366 extends toward the deflection zone 64 far enough for the wave loop section 388 nearest the axis of rotation 62 to form a roller which, with respect to its inclined position and its mode of action, substantially coincides with the contact roller 80 in FIG. 9. Therefore a separate contact roller is not necessary. To obtain a good contact effect, however, it is expedient if at least the wave loop sections 388 of roll 366 consist of a firm, practically inelastic material.

Figure 19:
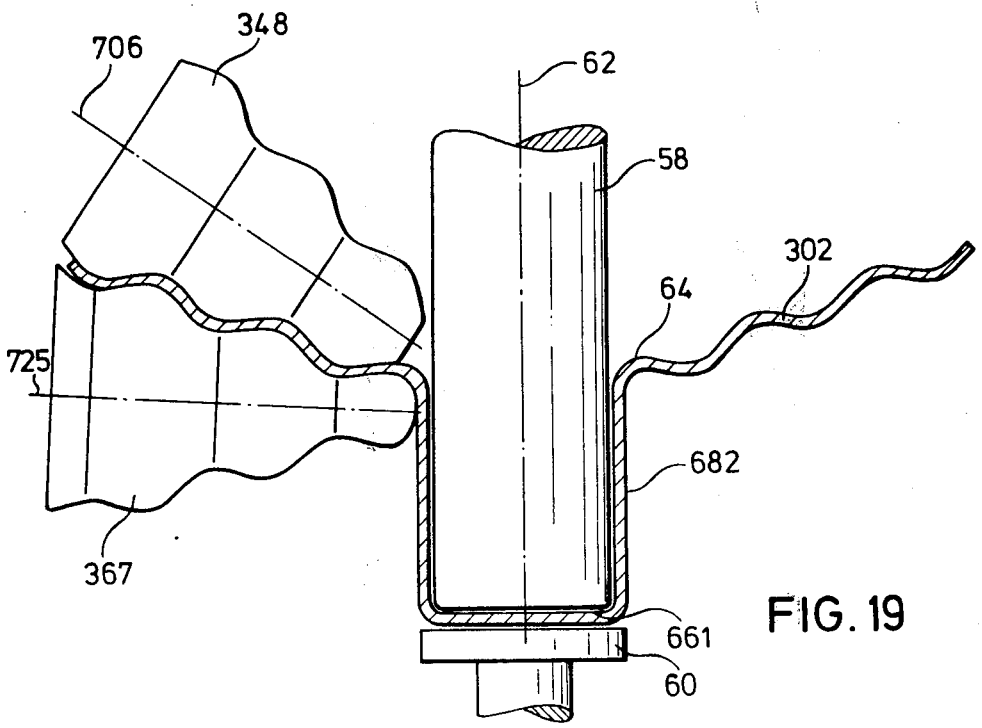

FIG. 19 shows a modification of the apparatus according to FIG. 18, the roll 366 being replaced by a roll 367 of frusto-conical form whose tip rests on the axis of rotation 62. This roll also extends radially inwardly to under the concave side of the deflection zone 64 and there forms a roller which is adapted to the concave side of the deflection zone and presses the material against mandrel 58 after passage through the deflection zone 64. Since a contact roller can be again omitted, and since the rolls 348,367, because they are rotational bodies are very easy to manufacture by a turning technique, the apparatus can be produced at an attractively low cost.

The top view of the apparatus according to FIGS. 18 and 19 and the form of the rolls may correspond to one of those depicted in FIGS. 11 to 13. Also when using the plane disk 30 provided there and with a corresponding position of the rolls 348,366 and 348,367 respectively, a roll can, in principle, protrude inwardly far enough for its inner end to serve to press the material against mandrel 58. This is possible in an especially favorable manner when shaping plates 302 of truncated cone form with the tip lying on the axis of rotation 62 as described with reference to FIGS. 18 and 19.

Figure 20:
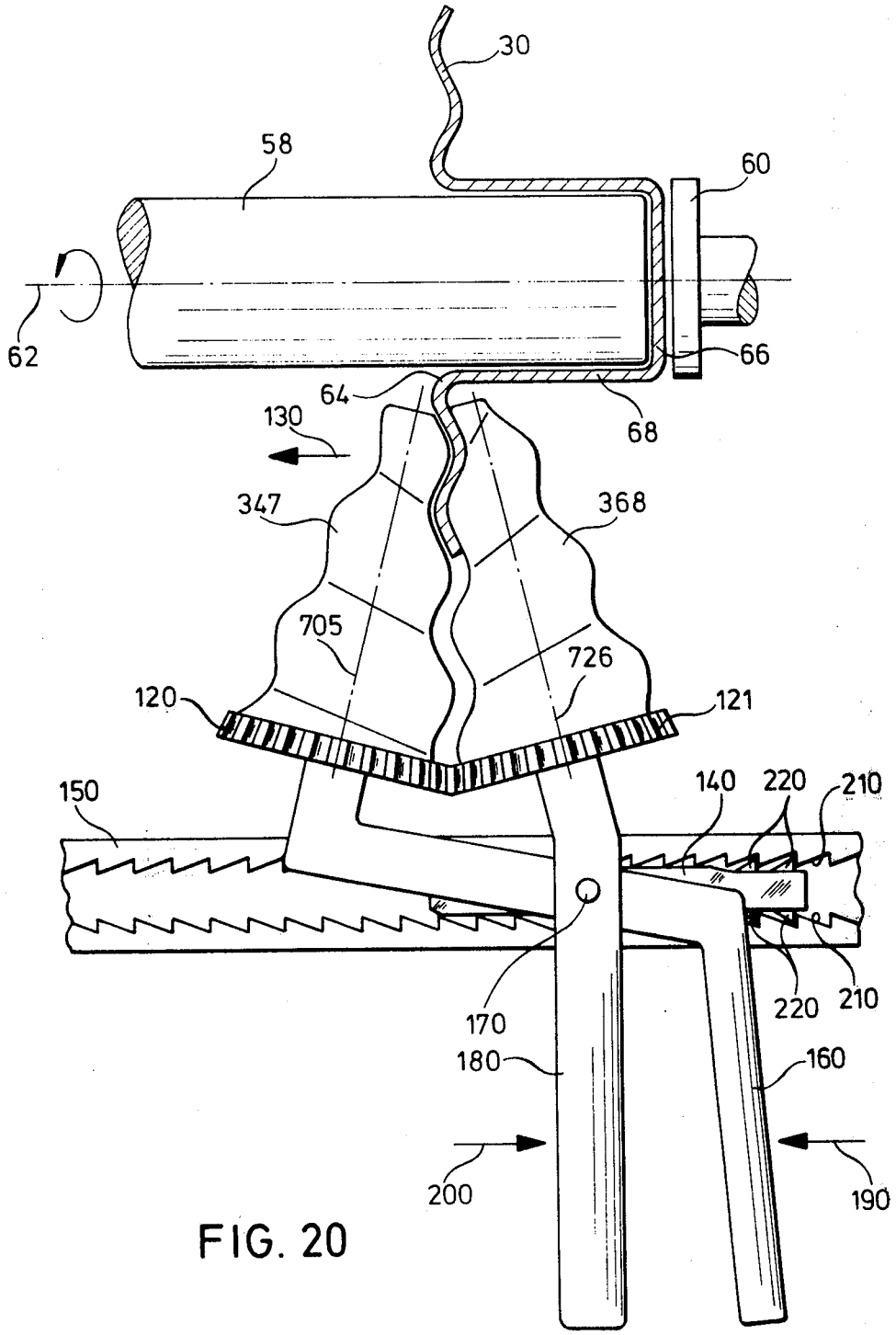
FIGS. 20 and 21 are top views of embodiments of devices which can be formed at low cost for conventional machine tools and which can be operated by hand.

FIG. 20 shows schematically an apparatus for the production of beaker type hollow bodies. Here the forming mandrel 58 is driven by a machine tool, e.g. a lathe or spinning lathe, and disk 30 is pressed by the contact plate 60 rotatably supported by the tailstock against the end face of mandrel 58, so that it is driven in rotation by the latter. It in turn frictionally drives two rolls 347,368, resulting in an undular deformation and in a transposition of the waves radially inwardly, as has been described with reference to FIG. 14. To forcibly effect a synchronization of the rolls 347,368, they are connected at their radially outer ends with bevel gear rims 120,121 meshing with one another. The lengths of the rolls 347,368 in the direction of their axes of rotation 705,726 are shown substantially shortened for clearer illustration.

Mandrel 58, contact plate 60, and hence bottom 66 are immovable in the direction of the axis of rotation 62. The rolls 347,368, instead, are displaced away from the bottom 66 jointly parallel to the axis of rotation 62 in the direction of arrow 130 during the shaping operation. For this purpose they are supported by a slide 140 which is displaceable in a slide-rail 150 extending parallel to the axis of rotation 62 and supported for example by the tool carriage of a lathe. Roll 347 is mounted at the free end of a Z-shaped lever 160 which is pivotably mounted on slide 140 at a pivot point 170 near its point of articulation away from roll 347. The lever arm of lever 160 lying beyond the pivot point 170 seen from roll 347 is designed as a handle extending approximately perpendicularly to the direction of displacement. Roll 368 is mounted at the free end of another lever 180, which also is pivotable about the pivot point 170 and has a slight flexure. Thus, its arm lying beyond the pivot point 170 seen from roll 368 and again designed as a handle is likewise perpendicular to the direction of displacement. With respect to the direction of displacement indicated by arrow 130, the pivot point 170 always lies behind the original plate plane, physically shifted but still defined by disk 30, and hence between said plane and the bottom 66.

The rolls 347,368 may be pressed against disk 30 on both sides thereof in order to perform a shaping operation with the arms of levers 160, 180 being pivoted toward each other in the direction of the arrows 190,200. If, however, the handle of lever 180 is let go and a force is exerted on lever 160 in the direction of arrow 190, then slide 140 is thereby shifted in the direction of arrow 130. A return movement is prevented by a ratchet device acting on slide 140 and operative in only one direction of displacement, the device being formed by sawtooth-shaped detent faces 210 formed in slide-rail 150 and by detent blocks 220 which are mounted for displacement in slide 140 crosswise to the direction of displacement thereof and which are brought into engagement with the detent faces 210 by spring force. As soon as the displacement has taken place by means of lever 160, the handle ends of both levers 160,180 can be pushed toward each other again in the direction of arrows 190,200, whereby another shaping of disk 30 takes place. As the process continues, the rolls 347,368 can meanwhile be pivoted in the direction of arrow 200 by a joint movement of both levers 160,180 in such a way that the deflection zone 64 moves in the direction of arrow 130. The hollow body is thus formed in an approximately continuous manner.

Figure 21:
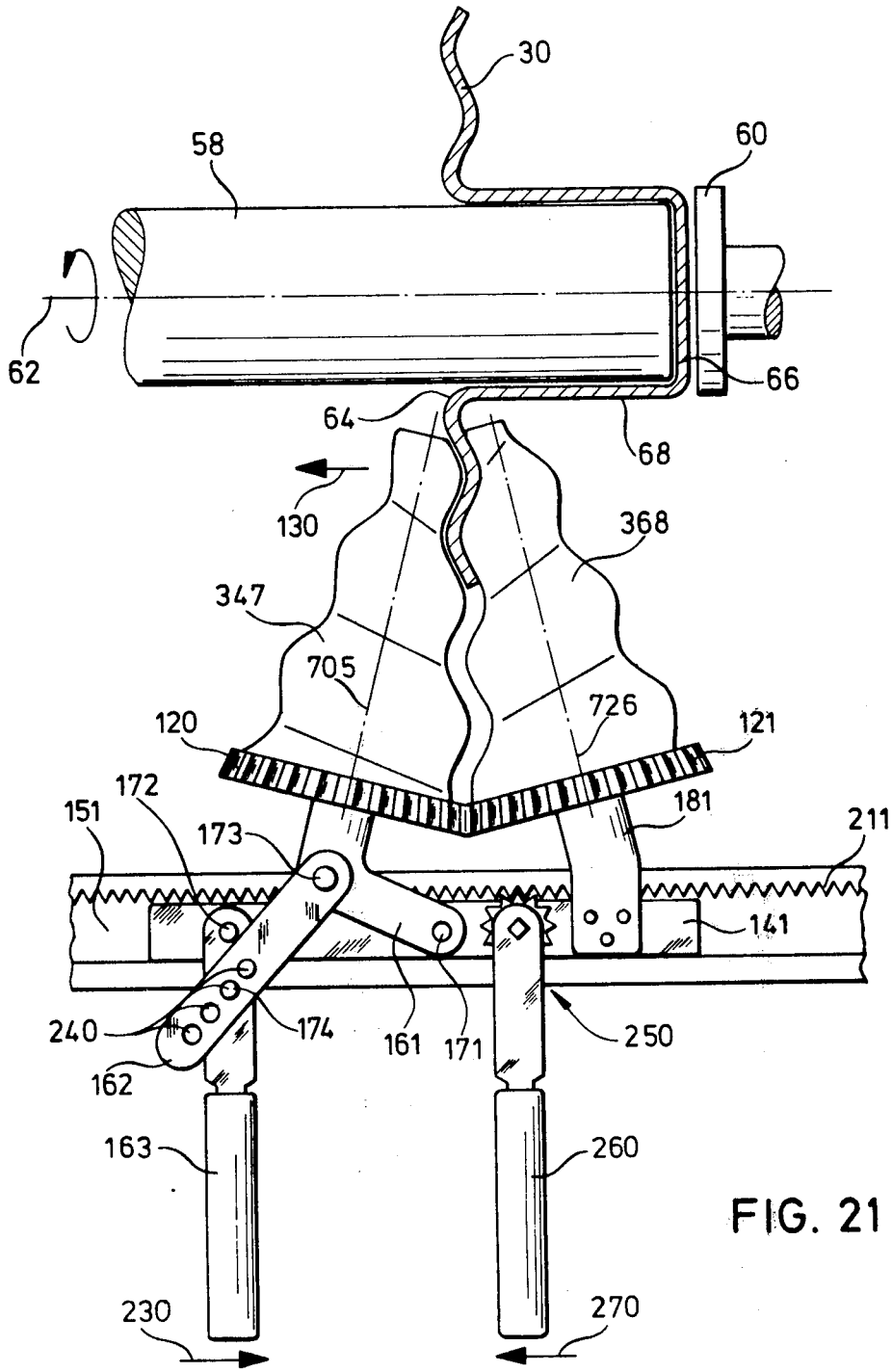

FIG. 21 shows a modification of the apparatus according to FIG. 20. Here again a slide 141 displaceable in a slide rail 151 parallel to the axis of rotation 62 has firmly connected thereto an arm 181 on which roll 368 is mounted. Roll 347 can be pressed against disk 30, and against roll 358 by means of a lever action. Roll 347 is mounted at the free end of a lever which is pivotable about a pivot point 171 at the slide 141, this pivot point lying at least in the original plate plane defined by disk 30. A handle 163 extending normal to the shift direction is articulated to a pivot point 172 at slide 141. A push-rod 162 extends between one pivot point 173 located at lever 171 in the vicinity of roll 347, and another pivot point in the form of a pin 174 formed at handle 163 near the pivot point 172. By pivoting the handle 163 in the direction of arrow 230, roll 347 is applied via push-rod 162 and lever 161 with a high degree of force. This force can be varied by the fact that several holes provided in the push-rod 162 can be used to form a swivel joint with pin 174.

For shifting slide 141 and hence the rolls 347,368 in the direction of arrow 130, a ratchet device 260 is provided. The teeth of a gearwheel of the ratchet device 260 engage in the rack 211 lying above the slide rail 151. Onward movement occurs by pivoting handle 260 in the direction of arrow 270. To permit a return movement counter to arrow 130 if desired, the ratchet 250 may be blocked with respect to each of its two directions of rotation, so that return to the starting position occurs after switching by pivoting handle 260 counter to the direction of arrow 270. With this arrangement, a disk 30 which is initially completely flat and which is clamped between mandrel 58 and contact plate 60 can be shaped into a hollow body.

In the embodiments according to FIGS. 20 and 21, it is in principle also possible to guide the rolls 347,368 not exactly parallel to the axis of rotation 62. For example, the slide rail 150,151 may have a slight inclination to the axis of rotation 62, so that in their displacement along the slide rail 150,151 the rolls 347,368 move radially outwardly away from the axis of rotation 62, in order thus to obtain a decreasing thickness of wall 68 with increasing axial length of wall 68 over the bottom 66. Also it is conceivable to use a slide rail extending along a given curve, to guide therein two axially spaced short slides which can follow the curves of the slide rail, to articulate the slides pivotably to a cross-piece connecting them, corresponding to the slides 100,141 as to length, and extending parallel to the slide rail, and to support the rolls 347,368 including actuating means on the cross-piece on the pattern of FIG. 20 or FIG. 21.

Figure 22:
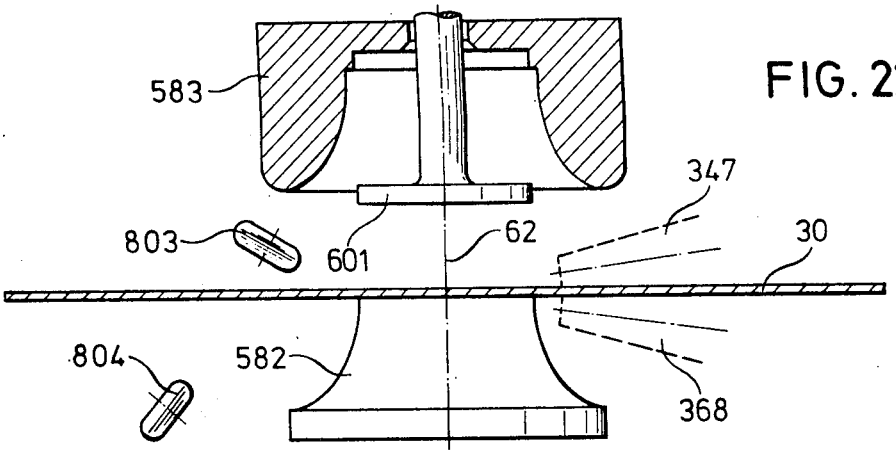
FIGS. 22 to 24 are sectional views of process steps in the production of a double walled hollow body on an apparatus suitable for that purpose.
Figure 23:
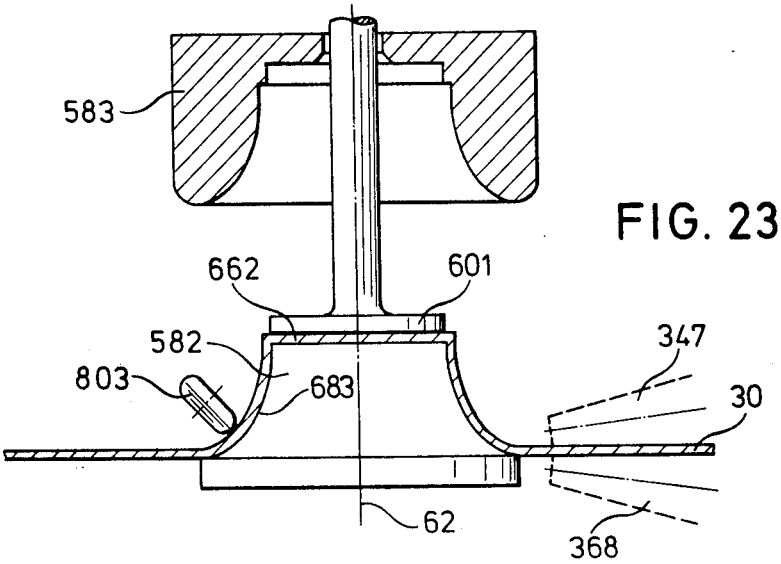
Figure 24:
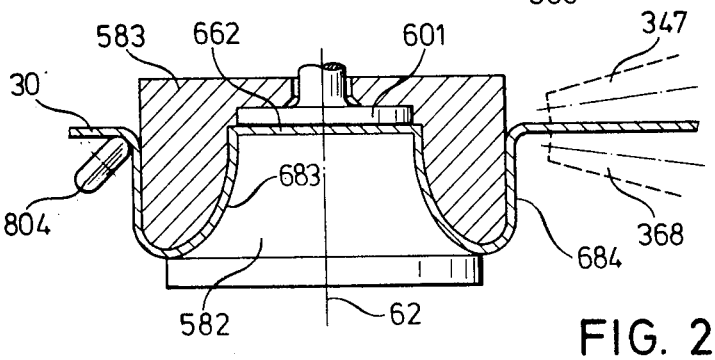

By means of the apparatus illustrated in FIGS. 22 to 24, double-walled hollow bodies can be produced, such as for example fairing and streamlining parts for aircraft, rockets and turbines. Such parts have heretofore been produced at great cost by deep drawing or form spinning, which usually involves shaping in several stages with annealing in each intermediate stage. In the case of thin sheet thicknesses, such hollow bodies must be made from several separately produced segments. With the apparatus and process of the invention, the hollow body can instead be produced fully automatically without intermediate stages.

The apparatus comprises an outer chuck 582, whose form matches the inner wall of the hollow body to be formed. Also provided are a ram 601 and a combined inner and outer chuck 583 which matches the outer wall of the hollow body. Two contact rollers 803,804, and at least one roll pair of one of the above described types shown schematically have their ends facing the axis of rotation 62, the rolls 347,368 being indicated by their basic body form with broken lines.

First, as shown in FIG. 22, a disk 30 is placed on the outer chuck 582. Then ram 601 is lowered to adapt disk 30 to the outer chuck 582, and the latter together with the disk 30 and ram 601 is set in rotation by means of a drive. Now the rolls 347,368 are applied, having previously been brought into the appropriate position with their radially inner ends relatively closely adjacent to the outer chuck 582. Thereby disk 30 is undularly deformed, and its material flows radially inwardly.

The material flowing radially inwardly is pressed, as FIG. 23 shows, against the outside of the outer chuck 582 by means of the contact roller 803, while the rolls 347,368 together with the remainder of disk 30 and the contact roller 803 are moved away from the now formed bottom 662 in the direction of the axis of rotation 62. At the same time the rolls 347,368 are moved radially outwardly, as the outer chuck 582 widens downwardly. If desired, as has been explained before, the material flow can be increased relative to its initial value upon outward displacement of the rolls 347,368.

When the form of the hollow body illustrated in FIG. 23 is reached, in which the inner wall 683 thereof is completed, then as FIG. 24 shows, chuck 582 is lowered and placed on the inner wall 683. This, however, in no way involves a mold-pressing between chuck 582 and chuck 583.

After the application of chuck 583, the axial direction of movement of the rolls 347,368 is reversed relative to the previous direction during formation of the inner wall 683. Rolls 347,368 are now displaced upwardly in FIG. 24 with their inner ends in the vicinity of the outside of chuck 583, the material being now pushed against the outside of chuck 583 by means of the contact roller 804. Chuck 583 now rotates together with chuck 582. The material pressed against the outside of chuck 583 forms the outer wall 684 of the hollow body. This wall can be raised, compared with the illustration of FIG. 24, for example to the level of the upper end of chuck 583.

For the above named purposes, the bottom 662 is removed from the completed hollow body, and a portion of the original disk 30 which might be projecting outwardly in the manner of a flange from the upper end of theouter wall 684 is cut off. The polishing of the hollow body on its sides away from chuck 583 can be accomplished by exchanging the outer chuck 582 for a contact plate opposed to contact plane 601 before bottom 662 is removed. During subsequent turning the chuck 583 then serves as a support during polishing, whereby undesired deformation is prevented.

Figure 25:
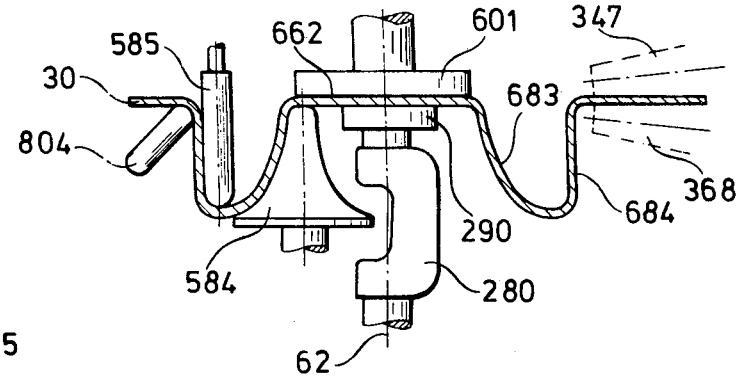
FIG. 25 is a sectional view corresponding to the representation of FIG. 24 through a similar apparatus modified relative to the apparatus according to FIGS. 22 to 24.

FIG. 25 shows a modification of the apparatus according to FIGS. 22 to 24, a roll chuck 584 being provided instead of the outer chuck 582 and a roll chuck 585 instead of chuck 583. The rotational drive is effected through ram 601, with an opposed contact plate 290 being rotatably mounted in a yoke 280. Yoke 280 allows the lower edge of the roll chuck 584 to extend in proximity to the axis of rotation 62 and possibly even beyond it.

Figure 26:
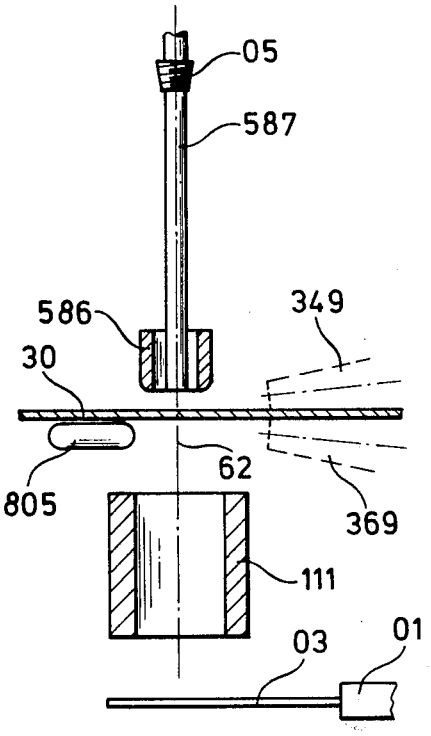
FIGS. 26 to 28 are sectional views showing process steps in the production of a steel bottle in apparatus suitable for that purpose.
Figure 27:
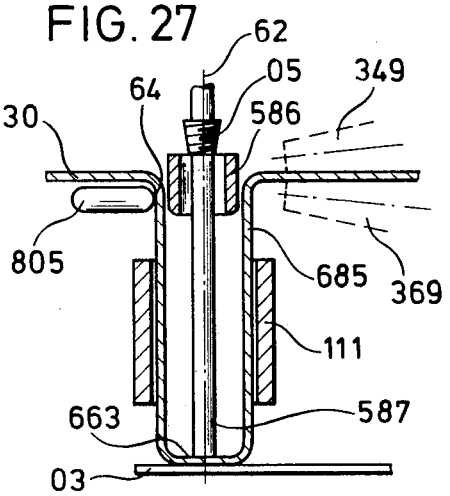
Figure 28:
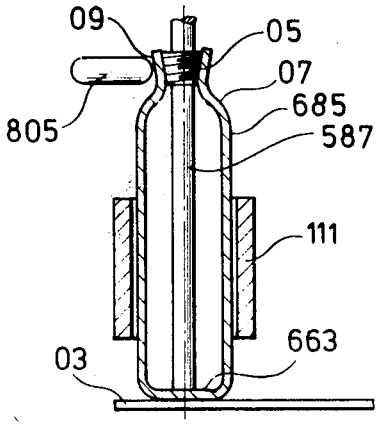

In the apparatus according to FIGS. 26 to 28, steel bottles may be made. Here, as shown in FIG. 26, a disk 30 is first fed in a horizontal direction and aligned relative to the axis of rotation 62. Then a chuck 586 whose outside diameter corresponds to the inside diameter of the steel bottle to be formed and whose lower edge corresponds to the inside form of the bottom to be formed is lowered onto disk 30. At least one roll pair 349,369, which can operate according to one of the modes described with reference to FIGS. 9 to 15, is brought up to the disk from both sides and applied. Prior thereto, the radially inner ends of the rolls 349,369 are displayed toward the outside of chuck 586 to a smaller radial distance relative to the outside diameter thereof. Rolls 349,369 are driven, whereby also disk 30 is set in rotation about the axis of rotation 62 and is provided with similar deformations. By transposing the undular deformations radially inwardly, the material of disk 30 is caused to flow in the direction of chuck 586. As soon as this occurs, chuck 586 is displaced vertically downwardly with a slight thrust, e.g. under its dead weight, with the bottom 663 (FIG. 27) of the bottle to be formed being first lowered downwardly out of the plane of disk 30. As the radially inward flow of the material continues, the material is radially deflected at the outside of chuck 596, to form the cylindrical wall 685 of the bottle.

Expediently chuck 586 is driven in rotation at the same speed as disk 30. As soon as chuck 586 has reached its position shown in FIG. 27, in which its lower end lies a given distance below the plane of disk 30, the downward movement of chuck 586 is stopped. The material flowing radially inwardly is from then on applied against chuck 586 in the deflection zone 64 and is deflected in the radial direction, with a contact roller 805 extending under the concave side of the deflection zone 64 assisting in the application of the material on that axial section of chuck 586 which is located below disk 30.

As soon as chuck 586 ceases to move downwardly, the further axial downward displacement of bottom 663 is guided by means of a mandrel 587 which passes through the central opening in chuck 586 coaxially to the axis of rotation 62, and which can be regulated with respect to its axial displacement speed. During the initial axial displacement of chuck 586, mandrel 587 is expediently displaced at the same speed out of the starting position shown in FIG. 26, in which its lower end is at the same level as the lower end of chuck 586. With such displacement, displacement of mandrel 586 simply needs to be continued steadily when the axial downward movement of chuck 586 ceases, and mandrel 587 takes over at the same moment the guiding of bottom 663.

Below the plate plane of disk 30, coaxially to the axis of rotation 62, an annular clamping sleeve 111 is arranged, which is expediently driven in rotation at the same speed as disk 30. As soon as wall 685 has sufficient length to protrude into the upper end of the clamping sleeve 111, a radial guiding of the wall 685 results.

At a given length of the cylindrical wall extending downwardly from the plate plane of disk 30, bottom 663 abuts a slide 03 which can be retracted from the path of the bottle to be formed crosswise of the axis of rotation 62 by means of a setting drive 01. The slide remains at first in its position in which is prevents a further downward movement of the bottle to be formed. The situation illustrated in FIG. 27 has thus been reached. At this moment chuck 586 is moved back axially upwardly into its starting position shown in FIG. 26.

At mandrel 587 an externally threaded plug 05 is provided at a height above bottom 663 which corresponds to the height of the neck of the bottle which is provided with an internal thread. It is now possible, by radially inward displacement of rolls 349,369 and of the contact roller 805 and simultaneous upward displacement, to form a transition 07 between the cylindrical wall 685 and the bottle neck 09 as shown in FIG. 28. The procedure is first to leave the radial position of rolls 349,369 and of the contact roller 805 unchanged and to form the cylindrical wall 685 by axial displacement of these parts to a height above bottom 663 which is greater than the desired axial height in the finished bottle. Thereafter it it possible in a simple manner, without further use of the rolls 349,369, to produce by means of the contact roller 805 both the transition 07 and the bottle neck 09 by the usual metal spinning, in that with a suitable cam control the contact roller 805 is caused to execute pivotal movements during which the form of the axial section of the cylindrical wall 685 increasingly approaches the form of the transition 07 and of the neck 09. Finally, the neck 09 is rolled onto the external thread 05 by the contact roller 805, thereby providing it with an internal thread. In the same manner, if desired, it is possible also to form a groove profile or other desired profile on the inside of the neck.

After completion of neck 09, any material protruding upwardly over plug 05 can be cut off. The formed bottle visible in FIG. 28 is then held against rotation by means of the clamping sleeve also held against rotation, whereby it is possible, by turning mandrel 587 and hence plug 05, to screw the latter out of the internal thread of neck 09. The bottle is thus completed. It is released by the clamping sleeve 111, slide 03 is pulled aside, and the bottle falls in an upright position onto a transport means disposed below slide 03. Should the bottle ever remain stuck in the clamping sleeve 111, the bottle can be ejected by a brief downward displacement of mandrel 587 with plug 05 after slide 03 has been opened.

By means of the apparatus according to FIGS. 26 to 28, steel bottles used for the storage of technical gases and metal containers for liquids, for example, can be produced in uninterrupted succession. Previously, such gas bottles were produced laboriously by deep drawing, stretch-chasing and spinning with interposed heat treatment operations. With the apparatus shown, no intermediate steps and no heat treatments are necessary and the entire production process can be easily controlled, automated or carried out by a worker without specialized training.

Figure 29:
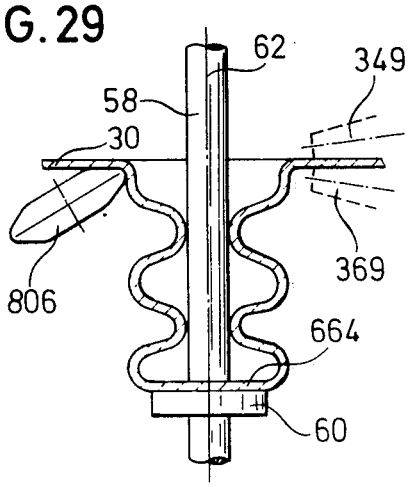
FIG. 29 is a sectional view showing apparatus for producing hollow bodies of different axial cross-sections.

Lastly, FIG. 29 is provided to illustrate the possibility of forming hollow bodies with different inside widths in the axial direction, with bulges and constrictions closely succeeding each other in the axial direction. A mandrel 58 can be used whose diameter equals the smallest inside diameter involved, in order to bring the bottom 664 out of the plate plane of disk 30 together with the contact plate 60. During this axial movement in the direction of the axis of rotation 62, one or more roll pairs 349,369 and the contact roller 806 are displaced in a radial direction, depending on the required diameter of the formed hollow body. The displacement can take place here, as in all similar cases, for example by means of a template, a nut mandrel or by means of a program-controlled computer.

After removal of bottom 664, the hollow bodies produced for example according to FIG. 29 can serve as bellows to be inserted in conduits to compensate temperature-related length variations, as nozzles or also as lamp columns, e.g. so-called "flemish columns".

Finally, it should be noted that the process and apparatus according to the invention overcome the process-related deformation limits that exist in known processes. The deformation limits according to the present process are set essentially by the ultimate limits of the material to be deformed under swelling compressive stress. Degrees of deformation can thus be attained which can normally be achieved only in flow-pressing, extruding, and tube rolling. Further the new process offers the greatly improved possibility of defining the entire shaping process in the production of hollow bodies, at least for rotationally symmetrical forms, in scientifically exact terms and therefore enables exact control over its technology. For these reasons the process is especially well suited for continuously repetitious operations controlled or regulated in time within wide limits, and in particular fully automated.

An important advantage of the process and of the apparatus according to the invention consists in that the material to be shaped is exposed only to a swelling compressive stress and that also high-strength materials, e.g. steels of a strength of the order of 350 kg/mm$^2$, can be shaped. Other processes are not practically suited for this purpose. For example, shaping of a disk of high-strength steel by spinning is not feasible since due to the spring properties of the material destruction of the material takes place upon application of the required shaping forces at a circumferential point of the disk. The process according to the invention is expediently carried out, at particularly high strength values of the fabricated metal and at very high degrees of deformation, at a temperature of the metal plate which lies in the recrystallization range of the material. An important area of application also is the shaping of materials, in particular steels, which only in shaping, particularly in the recrystallization temperature range, attain high strength values of the above stated order of magnitude and great toughness.

While specific embodiments of the invention have been shown and described in detail to illustrate the application of the inventive principles, it will be understood that the invention may be embodied otherwise without departing from such principles.

I claim:

1. Process for producing a hollow body from a plane or conical-shell shaped blank consisting of a shapable material, in particular metal, the blank being undularly deformed starting at at least one machining point with formation of at least one wave loop arched to one side relative to the original center-line, the blank and the machining point being mutually rotated about an axis of rotation extending at least approximately through the cross-sectional center of gravity of the hollow body to be formed, and in so doing the undular shaping being continued with formation of a propagating wave having a directional component extending in circumferential direction, and the wave being transposed by repeated undular shaping at machining points radially offset relative to each other in a direction which contains a predominantly radial directional component, characterized in that the waves are transposed exclusively parallel to the original plane of the blank and in a single directional sense toward the hollow body to be formed, and that, in a deflection zone annularly surrounding the cross-sectional center of gravity of the hollow body to be formed in spaced relation, the material is brought out of the original plane of the blank with formation of the hollow body wall.

2. Process according to claim 1 for producing a hollow body having cross-section dimensions smaller than the external dimensions of the blank, characterized in that the wave is transposed in a direction toward the axis of rotation.

3. Process according to claim 1 for producing a hollow body having cross-section dimensions at least approximately equal to the external dimensions of the blank, characterized in that a blank is used which has a central, preferably circular opening, and that the wave is transposed in a direction away from the axis of rotation.

4. Process according to claim 1, characterized in that the blank is maintained at a temperature which lies in the recrystallization range of the material.

5. Process according to claim 1, characterized in that the undular shaping is started with formation of the propagating wave at a radial distance from the deflection zone of the blank which approximately corresponds to the radial extent of the blank, and is continued exactly in circumferential direction.

6. Process according to one of claim 1, characterized in that the undular shaping is continued with radial displacement of the machining point and with formation of a wave at least approximately spiral, preferably over the entire radial extent of the blank.

7. Process according to claim 1, characterized in that the undular shaping occurs by rolling.

8. Process according to claim 1, characterized in that the transposing of the wave occurs point by point at machining points succeeding each other in a circumferential direction of the blank, which machining points are rotated relative to the blank synchronously with that machining point at which the undular shaping is begun with formation of the propagating wave, the wave being preferably transposed by a path smaller than half the wave width measured in the direction of this path.

9. Process according to claim 8, characterized in that the transposing occurs at machining points formed at equal mutual angular intervals in the circumferential direction.

10. Process according to claim 1, characterized in that transposing occurs after a full relative rotation between blank and machining point and after a radial displacement of the machining point.

11. Process according to claim 1, characterized in that the blank is undularly shaped at the same circumferential point simultaneously at at least two, preferably several evenly radially spaced machining points.

12. Process according to claim 11, characterized in that, at the same circumferential point, waves are formed simultaneously which alternate in a radial direction, are directed to both sides of the original plate center line, and preferably extend approximately sinusoidally.

13. Process according to claim 12, characterized in that upon transposition of the wave the blank is shaped at the wave loops to the extent that thereafter the material grain lying on the convex side is, possibly after elastic contraction, at least approximately tensionless.

14. Process according to claim 11, characterized in that, after the radial displacement of the machining points by a path which corresponds to the radial mutual distance of the matching points, the front machining point taken in the shift direction is abolished and behind the last machining point taken in the shift direction a new machining point is formed.

15. Process according to claim 1, characterized in that, for producing a hollow body with different wall thickness along the axis of rotation, the undular shaping occurs with different intensity in time over several relative rotations between blank and machining point.

16. Process according to claim 1, characterized in that, when producing a hollow body with a cross-section differing from a circular form, the undular shaping occurs with different intensity at corresponding circumferential points of the blank.

17. Process according to claim 2, characterized in that, for producing a hollow body with different inside width along the axis of rotation, the undular shaping is intensified upon variation of the width of the deflection zone.

18. Process according to claim 15, characterized in that the amplitudes of the waves are varied in magnitude.

19. Process according to claim 15, characterized in that the relative velocity between blank and machining point is varied in time.

20. Process according to one of claim 15, characterized in that the angular position of the machining point is varied.

21. Process according to claim 15, characterized in that the radial position of the machining point relative to the axis of rotation is shifted.

22. Process according to claim 1, characterized in that, for producing a hollow body with a spacing of the hollow body wall from the axis of rotation varying along the axis of rotation and/or in circumferential direction, the machining point is radially shifted according to the respective variation of the distance of the deflection zone from the axis of rotation.

23. Process according to claim 1, characterized in that at the machining point the blank is supported on its side opposite the machined side.

24. Process according to claim 1, characterized in that the deflecting is effected by applying the material flowing through the deflection zone against a chuck.

25. Process according to claim 24, characterized in that the deflected material is pressed against the chuck from its side opposite the chuck.

26. Process according to claim 1, characterized in that the deflecting is effected by forming tools, in particular rollers, acting only in the deflection zone.

27. Process according to claim 1, characterized in that the blank is seized in the region lying beyond the deflection zone with respect to the flow direction of the material and is guided relative to a radial displacement.

28. Process according to claim 27, characterized in that the blank is driven in rotation in its seized region.

29. Process according to claim 1, characterized in that the region of the blank lying beyond the deflection zone with respect to the flow direction of the material and the original plane of the blank are moved away from each other in the direction of the axis of rotation at a given relative speed.

30. Process according to claim 29, characterized in that the relative speed is regulated in the sense of maintaining constant the axial position of the deflection the relative to the original plane of the blank.

31. Process according to claim 2 for producing a double-walled hollow body, characterized in that, for the formation of the outer wall of the hollow body, the relative movement direction between the regions of the blank lying inside and outside the deflection zone is reversed.

32. Process according to claim 2 for producing a bottle type hollow body having a bottom, a cylindrical wall section, a neck narrower that this wall section, and a transitional region connecting the cylindrical wall section and the neck, characterized in that a beaker type hollow body, longer than the axial length of the cylindrical wall section, is formed, and that, on its length in excess over the desired length of the cylindrical wall section, the beaker type hollow body is drawn in preferably by spinning with formation of the transitional region and of the neck.

33. Apparatus for producing a hollow body from a plane or conical-shell shaped blank consisting of a shapable material, in particular metal, the blank being undularly deformed starting at at least one machining point with formation of at least one wave loop arched to one side relative to the original center-line, the blank and the machining point being mutually rotated about an axis of rotation extending at least approximately through the cross-sectional center of gravity of the hollow body to be formed, and in so doing the undular shaping being continued with formation of a propagating wave having a directional component extending in circumferential direction, and the wave being transposed by repeated undular shaping at machining points radially offset relative to each other in a direction which contains a predominantly radial directional component, characterized in that the waves are transposed exclusively parallel to the original plane of the blank and in a single directional sense toward the hollow body to be formed, and that, in a deflection zone annularly surrounding the cross-sectional center of gravity of the hollow body to be formed in spaced relation, the material is brought out of the original plane of the blank with formation of the hollow body wall, said apparatus including a rotatable roll with undularly extending generatrices, also including a rotatable abutment present opposite the roll at a nip, characterized in that also the abutment is a roll (362) with generatrices extending undularly at least at the nip (402), that at the nip (402)

the wave loops (384,485) of the generatrix of one roll (342,362) are opposite the wave troughs (484,385) of the generatrix of the respective other roll (362,342), and that the roll pair (342,362) with a nip (402) extending along the original plane of the blank (30) and with roll axes (70,72) extending at least approximately normal to the axis of rotation (62) is arranged upstream of the deflection zone (64) with respect to the flow direction of the material.

34. Apparatus according to claim 33, characterized in that at least one roll (342,362) has annularly revolving wave loops (364,465) and wave troughs (385,484).

35. Apparatus according to claim 34, characterized in that the highest points and lowest points, respectively, of the wave loops (384,485) and wave troughs (385,484) lie on circles whose plane is perpendicular to the wave axis (70,72).

36. Apparatus according to claim 34, characterized in that the highest points and lowest points, respectively, of the wave loops and wave troughs lie on curves whose plane is inclined to the wave axis (70,72).

37. Apparatus according to claim 33, characterized in that at least one roll (347) has wave loops (386) and wave troughs (387) extending along helical lines.

38. Apparatus according to claim 33, characterized in that at least one roll (366) has a cylindrical basic form.

39. Apparatus according to claim 33, characterized in that at least one roll (366) consists of several mutually rotatable sections (388,389), preferably contiguous to each other.

40. Apparatus according to claim 33, characterized in that at least one roll (347) has a truncated cone-shaped basic form with cone tip coinciding at least approximately with the axis of rotation (62).

41. Apparatus according to claim 33, characterized in that at least one roll consists of a rubber-elastic material at least in its jacket.

42. Apparatus according to claim 33, characterized in that the length of the rolls (342,362), measured in the direction of the roll axes (70,72), is at least approximately equal to the original radial extent of the blank (30) measured from the deflection zone (64).

43. Apparatus according to claim 33, characterized in that several, preferably three roll pairs (342,362; 343,363; 344,364) arranged at mutual angular distances are provided, and that the machining points formed between wave loops (384) of one roll and wave troughs (484) of the other roll (362) of a roll pair (343,362) are radially offset relative to similar machining points of the adjacent wave pair (343,363).

44. Apparatus according to claim 33, characterized in that a single roll pair (347,368) is provided.

45. Apparatus according to claim 37, characterized in that, preferably by radial displacement of the rolls (347,368) relative to the axis of rotation (62), at every point of the nip the radius of the basic body of the roll (347,368), measured from the roll axis (705,726), is chosen so that the circumference of the blank (30) extending through this point of the nip is a non-integral multiple of the circumference of the basic body of the roll (347,368).

46. Apparatus according to claim 33, characterized in that the rolls (347,368) of the roll pair are coupled together in the sense of equal speeds of rotation, preferably by means of meshing gears (120,121).

47. Apparatus according to claim 33, characterized in that the mutual spacing of the rolls (347,368) of the roll pair is adjustable.

48. Apparatus according to claim 33, characterized in that the rolls (342,362) of the roll pair are jointly adjustable in their radial position relative to the axis of rotation (62).

49. Apparatus according to claim 45, characterized in that the rolls (347;365) of the roll pair are jointly adjustable in their angular position relative to the axis of rotation (62).

50. Apparatus according to claim 47, characterized in that the adjustment occurs by means of an adjusting drive.

51. Apparatus according to claim 50, characterized in that the adjusting drive is controlled or regulated as a function of the respective relative rotation between the blank (30) and the original position of the roll pair in the sense of maintaining constant the distance of the end of the rolls (347;365) toward the deflection zone (64) from the deflection zone (64).

52. Apparatus according to claim 33, characterized in that the rolls (342,362) are driven in rotation.

53. Apparatus according to claim 33, characterized by a preferably rotatable chuck (58,581 to 586) arranged beyond the deflection zone (64) with respect to the flow direction of the material, approximately at the axial height of the original plate plane.

54. Apparatus according to claim 53, characterized by a contact roller (80, 801,803 to 805) arranged radially outside the chuck (58,581 to 586) with axial direction preferably inclined to the axis of rotation (62).

55. Apparatus according to claim 33, characterized by a forming tool (92), arranged at the inner circumference of the deflection zone (64) preferably inclined to the axis of rotation (62), and an abutment arranged opposite said tool on the concave side of the deflection zone (64) and preferably designed as a roller (802).

56. Apparatus according to claim 33, characterized by a guide element (58,100,586,587) displaceable coaxially with the axis of rotation (62) and attachable on the region (60,98,661) of the blank (30,301,302) lying beyond the deflection zone (64) with respect to the flow direction of the material.

57. Apparatus according to claim 33, characterized by at least two guide elements (58,60; 100,60; 582,601; 290,601) displaceable relative to each other coaxially with the axis of rotation (62) and seizing between them the region (66,98,661,662) of the blank (30,301,302) lying beyond the deflection zone (64) with respect to the flow direction of the material.

58. Apparatus according to claim 57, characterized in that the guide elements (58,60; 100,60) are displaceable jointly in the direction of the axis of rotation (62) and drivable in rotation preferably about the axis of rotation (62).

59. Apparatus according to claim 56, characterized by a measuring device (76,78; 90,78) measuring the axial position of the deflection zone (64) with respect to the original plane of the blank (30), and in that the displacement speed is regulable as a function of the measuring signal generated by the measuring signal generated by the measuring device (76,78; 90,78) in the sense of maintaining the axial position of the deflection zone (64) constant.

60. Apparatus according to claim 57, characterized in that the rolls (347,368) are axially adjustable relative to the gripped region (662).

61. Apparatus according to claim 44, characterized in that the rolls (347,368) are guided, preferably by means of a slide (140,141) and slide-rail (150,151) and preferably parallel to the axis of rotation (62), that at least one roll (347,368) is pivotable normal to the blank (30) about a swivel joint (170,171) provided radially beond its end way from the deflection zone (64), and that ratchet means (210,220; 211,250) are provided which permit a displacement of the rolls (347,368) in one direction of displacement only.

62. Apparatus according to claim 53 for producing a bottle type hollow body, characterized in that the guide element is a mandrel (587), preferably adjustable in vertical direction coaxially with the axis of rotation (62), and which is axially displaceable through a central opening in the axially displaceable chuck (586) also coaxial with the axis of rotation (62), independent of said chuck.

63. Apparatus according to claim 62, characterized in that the mandrel (587) carries an externally profiled plug (05) at a distance from its free end corresponding to the axial height of the hollow body.

64. Apparatus according to claim 62, characterized by a clamping sleeve (111) which is arranged coaxial with the axis of rotation (62), can preferably be driven in rotation, receives the formed hollow body on a portion of its axial length, and can be coupled non-rotationally therewith.

65. Apparatus according to claim 62, characterized by a slide (3) arranged below the mandrel (587) and displaceable preferably by means of an adjusting drive (1).

66. Apparatus according to claim 33, characterized in that the rolls (345,376) are inclined relative to a course of their roll axes (703,704) intersecting the axis of rotation (62).

67. Apparatus according to claim 33, characterized in that the nip (402) between the rolls (342,362) has a width remaining contant over its radial extent.

68. Apparatus according to claim 33, in particular for producing a hollow body from a blank of a thickness greater than the thickness of the wall of the hollow body, characterized in that the nip (402) between the rolls (342,362) has a width decreasing toward the deflection zone (64).

69. Apparatus according to claim 33, characterized in that at least one roll (342,362) of the pair is adjustable in a direction toward the other roll (362,342) of the same pair with variation of the width of the nip (402).

70. Apparatus according to claim 33, characterized in that the end - away from the deflection zone (64) - of at least one roll (342,362) of the pair is adjustable in a direction toward the other roll (362,342) of the same pair with variation of the angle enclosed by the roll axes (70,72).

* * * * *